US006466186B1

(12) United States Patent
Shimizu et al.

(10) Patent No.: US 6,466,186 B1
(45) Date of Patent: Oct. 15, 2002

(54) METHOD AND APPARATUS FOR DRIVING PLASMA DISPLAY PANEL UNAFFECTED BY THE DISPLAY LOAD AMOUNT

(75) Inventors: Masahiro Shimizu; Toshiro Wakabayashi, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/404,318

(22) Filed: Sep. 24, 1999

(30) Foreign Application Priority Data

Sep. 28, 1998 (JP) ..... 10-273018
Aug. 18, 1999 (JP) ..... 11-231862

(51) Int. Cl.[7] ..... G09G 3/28
(52) U.S. Cl. ..... 345/60; 345/63
(58) Field of Search ..... 345/63, 76, 60, 345/67, 213, 208; 315/169.4, 169.1; 326/26; 327/108, 111

(56) References Cited

U.S. PATENT DOCUMENTS 4,063,131 A * 12/1977 Miller ..... 315/169.4
4,070,663 A * 1/1978 Kanatami et al. ..... 345/76
4,087,805 A * 5/1978 Miller ..... 345/208
4,087,807 A * 5/1978 Miavecz ..... 345/208
4,130,779 A * 12/1978 Miller et al. ..... 315/169.4
5,621,342 A * 4/1997 Wong et al. ..... 327/108
5,642,018 A * 6/1997 Marcotte ..... 315/169.4
5,698,991 A * 12/1997 Kamiya ..... 326/26
5,745,086 A * 4/1998 Weber ..... 345/63
5,854,540 A * 12/1998 Matsumoto et al. ..... 315/169.1
5,943,030 A * 8/1999 Minamibayashi ..... 345/60
5,994,929 A * 11/1999 Sano et al. ..... 327/111
6,084,559 A * 7/2000 Nagao et al. ..... 345/67
6,104,362 A * 8/2000 Kuriyama et al. ..... 345/213

FOREIGN PATENT DOCUMENTS

KP 97-17861 4/1997
KP 97-76453 12/1997

* cited by examiner

*Primary Examiner*—Steven Saras
*Assistant Examiner*—Uchendu O. Anyaso
(74) *Attorney, Agent, or Firm*—Sughrue Mion, PLLC

(57) ABSTRACT

A drive method of a plasma display panel is disclosed by which prescribed luminance is obtained when display load amount is large, and no luminance saturation is generated when the display load amount is small. This is a method of driving a plasma display panel by which luminescence of sub-fields at prescribed gradations is obtained by employing n sustaining pulses, and the time from the start of charge recovery of the sustaining pulses to the fixation of the output line to a sustaining potential and the time to the fixation to the ground potential are made variable.

14 Claims, 24 Drawing Sheets

METHOD AND APPARATUS FOR DRIVING PLASMA DISPLAY PANEL UNAFFECTED BY THE DISPLAY LOAD AMOUNT

BACKGROUND OF THE INVENTION

1. Field of the Invention

The present invention relates to a method and an apparatus for driving a plasma display panel, and more particularly to a method and an apparatus for driving a plasma display panel for realizing a high contrast information display terminal, flat television or the like by using a plasma display panel with high definition and large display capacity.

2. Description of the Related Art

Generally, a plasma display panel (referred to as PDP hereinafter) has a thin structure, is free from flickering and has a high display contrast ratio. Moreover, it has many features such as, that it can be made into a relatively large screen, a high response speed, is self-luminous and can be made multi-color luminous by the use of phosphors. Because of this, it has been used widely in recent years in the field of computer related display devices, in the field of color image display devices or the like.

According to the mode of operation, PDPs can be classified into two groups, namely, those of AC discharge type in which the electrodes are covered with a dielectric and is operated under the condition of indirect AC discharge, and those of DC discharge type in which the electrodes are exposed to the discharge space and is operated under the condition of DC discharge. The AC discharge type is further classified according to the driving method into memory operation type which utilizes the memory function of discharge cells and refresh operation type which does not utilize the function. The luminance of a PDP is proportional to the frequency of discharges, that is, the number of repetitions of the pulse voltage. In the refresh operation, type PDP, the luminance-falls off with the increase in the display capacity so that it is used mainly as a PDP of small display capacity.

FIG. 1 is a sectional view showing the configuration of one display cell of a PDP of the AC discharge memory operation type. The display cell is provided with a back face and a front face insulating substrates 1 and 2 made of glass, trace electrodes 5 and 6 which are arranged so as to overlap with a transparent scanning electrode 3 and a transparent sustaining electrode 4 formed on the insulating substrate 2. A data electrode 7 formed on the insulating substrate 1 so as to intersect perpendicularly the scanning electrode 3 and the sustaining electrode 4, a discharge gas space 8 formed between the insulating substrates 1 and 2 filled with a discharge gas such as He, Ne, or Xe or their mixture, barriers 9 for securing the discharge gas space 8 as well as for sectioning a display cell, a phosphor 11 for converting ultraviolet rays generated by the discharge gas into visible rays 10, a dielectric film 12 covering the scanning electrode 3 and the sustaining electrode 4, a protective film 13 made of magnesium oxide or the like for protecting the dielectric film 12 from the discharge, and a dielectric film 14 covering the data electrode 7.

Next, referring to FIG. 1, the discharge operation of a selected display cell will be described. When discharge is initiated by applying a pulse voltage exceeding a discharge threshold between the scanning electrode 3 and the data electrode 7, positive and negative charges are attracted to, and accumulated on, the surfaces of the dielectric films 12 and 14 on both sides, corresponding to the polarity of the pulse voltage. Since the equivalent internal voltage, namely, the wall voltage due to the accumulated charge has the polarity opposite to that of the pulse voltage, the effective voltage within the cell falls with the growth of the discharge. Accordingly, even if the pulse voltage is held at a constant level, it is unable to sustain the discharge, and eventually the discharge is ceased. After this happened, if a sustaining voltage which is a pulse voltage having the same polarity as that of the wall voltage is applied between adjacent scanning electrode 3 and the sustaining electrode 4, the wall voltage component is superposed as an effective voltage to it, so it is possible to sustain discharge beyond the discharge threshold even when the voltage amplitude of the sustaining pulse is small. Consequently, it is possible to sustain the discharge by the continuous application of the sustaining pulse between the scanning electrode 3 and the sustaining electrode 4. This is the memory function referred to in the above. The sustained discharge can be stopped by applying a broad low voltage pulse or a narrow erasing pulse, being a pulse comparable to the sustaining pulse voltage, capable of neutralizing the wall voltage between the scanning electrode 3 and the sustaining electrode 4.

Next, referring to a block diagram in FIG. 2 showing an example of the drive unit of the conventional PDP, the configuration of the PDP will be described. In the PDP, a sustaining electrode group 42 and a scanning electrode group 53 are provided mutually parallel on one surface, and a data electrode group 32 is provided in the direction perpendicular to these electrodes on the opposing surface. Display cells 22 are formed at the intersections of these arrays. The sustaining electrodes X are provided corresponding to respective scanning electrodes Y1, Y2, Y3, . . . , and Yn (n is an arbitrary positive integer) adjacent to them, and their respective one ends are connected in common.

Next, the configurations of plural kinds of driver circuit for driving the display cells 22 and a control circuit for controlling the driver circuits will be described. The drive unit is provided with a data driver 31 which drives one line portion of data of the data electrode group for the purpose of addressing discharge of the display cells 22, sustaining driver circuit 40 which performs common sustaining discharge for the purpose of sustaining discharge of the display cells 22, and a scanning driver circuit 50 which performs common sustaining discharge for the scanning electrode group 53. The sustaining driver circuit 40 and the scanning driver circuit 50 are composed of lowimpedance circuits and high impedance circuits as illustrated in FIG. 3. In addition, for the purpose of performing selective writing discharge during the addressing period, there is provided a scanning driver 55 which performs sequential scanning to the scanning electrodes Y1 to Yn of the scanning electrode group. The scanning driver 55 performs sustaining discharge by applying a sustaining pulse to its own power supply by means of the scanning driver circuit 50. A control circuit 61 controls all of the operations of the data driver 31, sustaining driver circuit 40, scanning driver circuit 50, scanning driver 55, and PDP 21. The main part of the control circuit 61 comprises a display data control part 62 and a drive timing control part 63. The display data control part 62 possesses a function of rearranging display data input from the outside to data for driving the PDP 21, stores temporarily the rearranged display data stream, and transfers them to the data driver 31 as display data DATA in synchronism with the sequential scanning of the scanning driver 55 during addressing discharge. The drive timing control part 63 converts various kinds of signal such as dot clock signal input from the outside into internal control signals for driving the PDP 21, and controls respective drivers and driver circuits.

Next, the drive sequence will be described. FIG. 4 is a diagram showing the state of formation of a plurality of sub-fields in the conventional drive unit of the PDP. In this example, a field having a period of 16.7 ms is divided into 8 sub-fields (abbreviated as SFs). It is arranged so as to be able to display 256 gradations by regulating the drive sequence through the combination of these sub-fields. Each sub-field is divided into a scanning period for writing display data corresponding to the weight of the sub-field, and a sustaining discharge period for displaying display data designated for writing. An image for one field is displayed by the superposition of respective sub-fields.

FIG. 5 is a diagram showing the details of a sub-field of prior art. The diagram shows a sustaining electrode driving waveform Wx that is applied in common to the sustaining electrodes, sustaining electrode driving waveforms Wy1 to Wyn applied to the sustaining electrodes Y1 to Yn, and data electrode driving waveforms Wdi (1□i□k) applied to the data electrodes D1 to Dk. One cycle of the sub-field is divided into a scanning period and a sustaining discharge period, where the scanning period is subdivided into a preliminary discharge period and a writing discharge period, and a desired image display is obtained by repeating this combination. The preliminary discharge period is employed as needed, and may be omitted.

The preliminary discharge period is the period for generating active particles and wall charges within the discharge gas space in order to prepare for obtaining a stabilized writing discharge during the writing discharge period. The period includes the application of a preliminary discharge pulse for simultaneous discharge of the entire display cells of the PDP, and a preliminary discharge erasing pulse for eliminating charges that hinder the writing discharge and sustaining discharge, among wall charges generated by the application of the preliminary discharge pulse.

The sustaining discharge period is the period for causing the display cell which was subjected to the writing discharge during the writing discharge period to undergo sustaining discharge for luminescence with desired luminance.

During the preliminary discharge period, first, a preliminary discharge pulse Pp is applied to the sustaining electrodes X to cause discharge in all display, cells. Then, an erasing discharge is generated by applying a preliminary discharge erasing pulse Ppe to the scanning electrodes Y1 to Yn to eliminate the wall charges accumulated by the preliminary discharge pulse.

Following that, during the writing discharge period, a scanning pulse Pw is applied line sequentially to the scanning electrodes Y1 to Yn, and a data pulse Pd is applied selectively to the data electrodes Di (1□i□k) corresponding to image display data, and wall charges are created by generating a writing discharge in a cell to be displayed. Then, during the sustaining discharge period, sustaining discharge is generated continuously only in the display cell which was subjected to writing discharge, by sustaining pulses Pc and Ps. After the final sustaining discharge is completed by a final sustaining pulse Pce, the formed wall charges are eliminated by a sustaining discharge erasing pulse Pse, and a luminescence operation for one image screen is completed by stopping the sustaining discharge.

SUMMARY OF THE INVENTION

It is a first object of the present invention to provide a plasma display panel which enables to obtain a satisfactory image quality irrespective of the size of the display load amount.

First, in the conventional drive method of the plasma display panel, the times from the start of charge recovery to the clamping to the sustaining potential and to the ground potential are fixed to prescribed values. Accordingly, when the times from the start of charge recovery to the clamping to the sustaining potential and to the ground potential are set short, there is a disadvantage in that luminance saturation takes place especially when the display load amount is small, and satisfactory display image cannot be obtained due to an excessively strong gas discharge intensity. On the other hand, when the times from the start of charge recovery to the clamping to the sustaining potential and to the ground potential are set long, there occurs a disadvantage that a required luminance cannot be obtained when the display load amount is large due to low gas discharge intensity.

Moreover, in the conventional drive method of the PDP, a plurality of display cells are driven by one line formed by an electrode pair of a sustaining electrode X of the sustaining electrode group and a scanning electrode out of Y1 to Yn of the scanning electrode group. In this case, the display current corresponding to display data of each line is approximately proportional to the display data amount (load amount) in the display cell. Each electrode has a distributed resistance component, which is larger for larger electrode length. As a result, a voltage drop occurs when a display current is supplied by the resistance component of the electrode, where the amount of the voltage drop depends on the display data amount. Further, a stray capacitance exists between the electrodes to begin with, so a voltage drop occurs also due to unwanted charge accumulation caused by the stray capacitance.

Furthermore, the sustaining driver circuit 40 and the scanning driver circuit 50 of the conventional device are composed of the combination of low impedance circuits and high impedance circuits as shown in FIG. 3, or of low impedance circuits alone. Both of the total output and each control signal are common to both circuits, and the time at which a control signal for low impedance circuit is turned on is fixed as shown in FIG. 6 which is an enlarged diagram illustrating the trailing edge A of the sustaining pulse in FIG. 5. In this case, since the discharge current is always supplied by the low impedance circuit, a voltage drop is induced depending on the display data amount as in the above.

Because of this, the voltage drop remains small when the display data amount is small, but the voltage drop increases as the display data amount becomes large, causing a difference in the display luminance between the lines. Namely, as shown in the solid line of the graph showing the dependence of the luminance on the display load amount in FIG. 14, the luminance is unnecessarily high when the display data amount is small, whereas the luminance drops when the display data amount is large. As a result, there arise irregularities in gradations which should be gradual intrinsically, and causes a problem that the luminance characteristic is discontinuous.

The present invention was motivated in view of the above problems, and it is the object of the invention to provide a drive method and a drive unit of a plasma display panel with excellent display quality which is capable of faithfully displaying the gradations of the display data regardless of the size of the display load amount by suppressing the rise in the luminance when the display data amount is small, and by preventing the drop in the luminance when the display data amount is large.

In order to achieve the above object, the present invention adopts basically the following technical setup.

Namely, in a drive method of a plasma display panel comprising a plurality of display cells arrange in a matrix form, in which the luminescence after writing discharge is sustained by means of sustaining discharge pulses, this invention is characterized in that the sustaining discharge pulse has at least a plurality of timing patterns. By the use of the plurality of timing patterns the display load becomes adjustable, and a faithful display of the gradations of display data becomes attainable.

In addition, the drive unit according to this invention is a device for the plasma display panel which causes a sub-field to luminesce with prescribed gradations using n sustaining pulses, and is provided with a variable means which varies the time from the start of charge recovery of the sustaining pulse to the clamping to the sustaining potential and the time to the clamping to the ground potential. Moreover, the variable means is composed of a first switching means which clamps the sustaining pulse to the ground potential, a second switching means for clamping the sustaining pulse to the sustaining potential, a third switching means for guiding the charge on the display cell of the plasma display panel to a recovery capacitor, a fourth switching means for guiding the charge on the recovery capacitor to the display cell, and a control circuit for controlling the switching timings of the first to the fourth switching means.

Furthermore, the drive unit is provided with an arithmetic means for calculating the display load amount of the display cell, and the result of calculation of the arithmetic means is used to control the variable means. It is preferable that the time from the start of charge recovery of the sustaining pulse to the clamping to the sustaining potential, and the time to the clamping to the ground potential are increased successively from the leading sustaining pulse to the n-th sustaining pulse, or that the times are made variable corresponding to the display load amount.

It is preferable that the drive unit of the plasma display panel according to this invention has means for resetting each display cell, a writing discharge means for deciding lighting or nonlighting of each display cell, and a sustaining discharge means for performing repeated luminous discharge based on the selective discharge in the writing discharge means, and is provided with a means for detecting display data for performing writing discharge for each line, a means for counting and storing the display load amount of the detected display data, and a means for variably controlling dynamically the point of impedance change in the sustaining discharge means for each line, at switching of the sustaining pulse during the sustaining discharge, corresponding to the display load amount of the detected display data.

The sustaining discharge means is composed of high impedance circuits and low impedance circuits. The high impedance circuit is composed of a circuit generating a leading edge (trailing edge) of the sustaining pulse, and the low impedance circuit consists of a circuit for clamping the sustaining pulse to the sustaining voltage and a circuit for holding it at the sustaining voltage, and the circuit for generating a leading edge (trailing edge) of the sustaining pulse is configured in a form to include a reactive power recovery means.

The operations mentioned above to be performed for each line may be performed for each sub-field or for each field.

BRIEF DESCRIPTION OF THE DRAWINGS

The above and other objects, features and advantages of the present invention will be more apparent from the following description taken in conjunction with the accompanying drawings in which.

DETAILED DESCRIPTION OF THE PREFERRED EMBODIMENTS

The drive method of the plasma display panel according to a first mode of embodiment of this invention is constructed so as to vary the timing for fixing the recovery deficiency component from the start of charge recovery of the sustaining pulse to the sustaining potential, and the timing for fixing to the ground potential, within the sustaining period for each sub-field.

Figure 7:
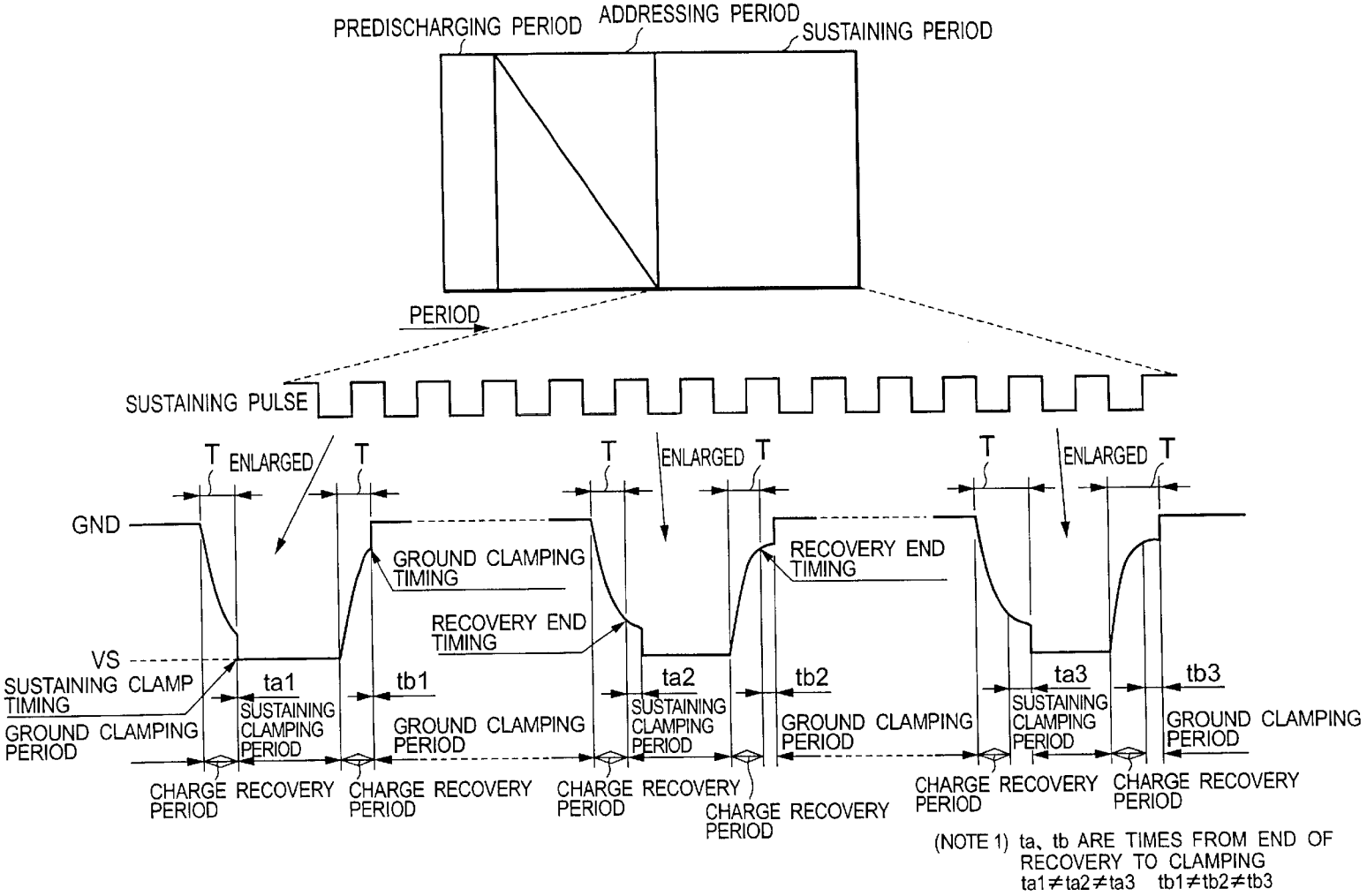
FIG. 7 is the waveform of the sustaining pulse and control timings of various control signals of the drive unit and the drive method according to this invention.

In FIG. 7 is shown a timing chart for controlling the sustaining pulse according to this invention. In the conventional drive method, the time from the start of charge recovery to the clamping to the sustaining potential and the time to clamping to the ground potential are fixed to constant values. On the contrary, in this invention, the time T from the start of charge recovery of the sustaining pulse to the fixation to the sustaining potential and the time T to the fixation to the ground potential are made to be variable. In other words, the times from the end of the charge recovery to the clamping to the sustaining potential and to the ground potential are arranged to be set to a plurality of values (ta1≠ta2≠ta3, and tb1≠tb2≠tb3) within the sustaining period.

With such an arrangement, when the luminous load amount is small and concentrated luminescence is obtained, it is possible to prevent luminance saturation that occurs concentrated in display areas with small drive power, and when the luminous load amount is large, it is impossible to control luminescence so as to prevent occurrence of luminous intensity deficiency by varying the timing for clamping to the sustaining potential or to the ground potential.

Accordingly, excellent display which is independent of the display load amount and is always free from luminance saturation can be obtained.

Figure 13:
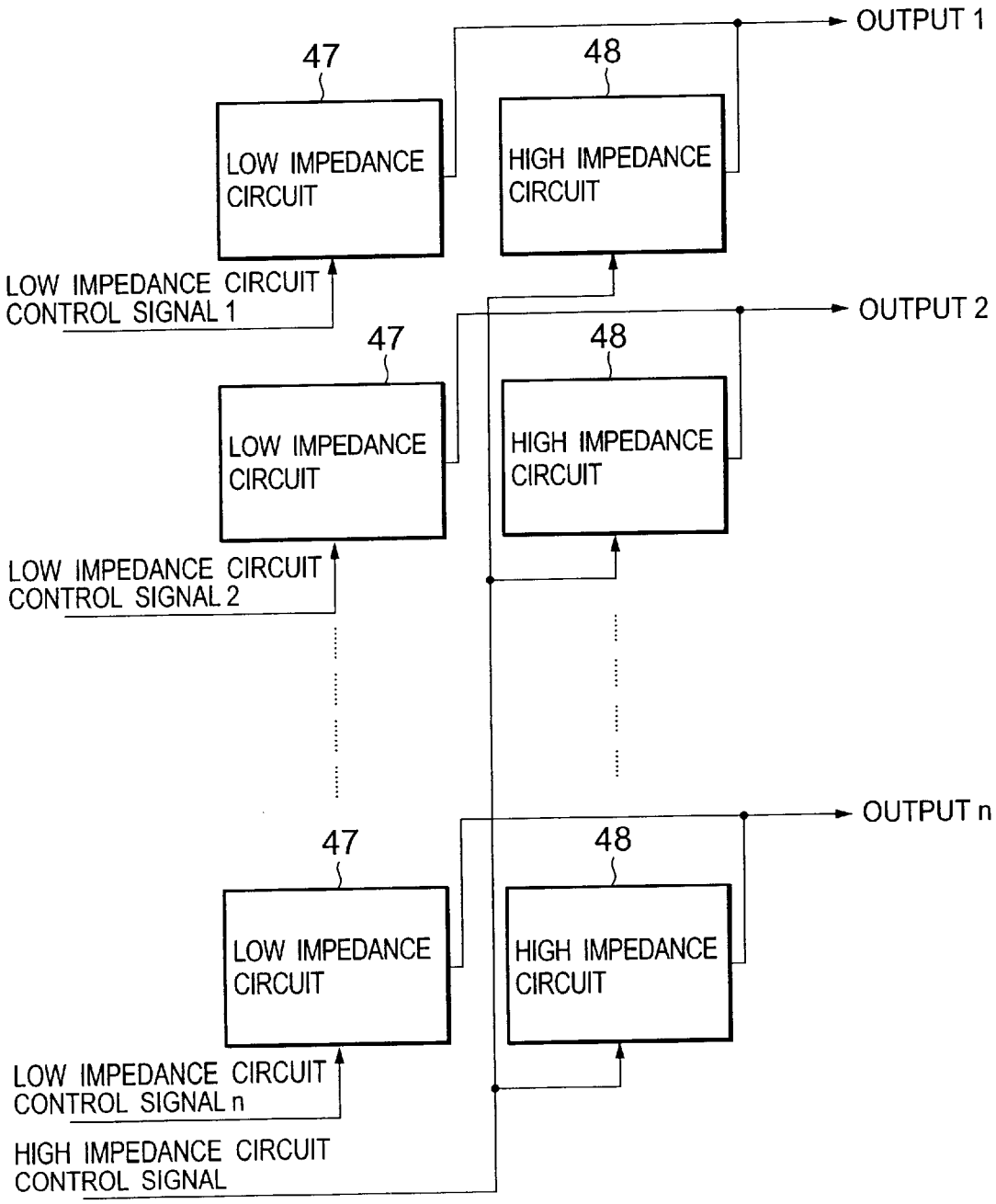
FIG. 13 is a block diagram of the driver circuit showing the principle of the second mode of embodiment of this invention.
Figure 14:
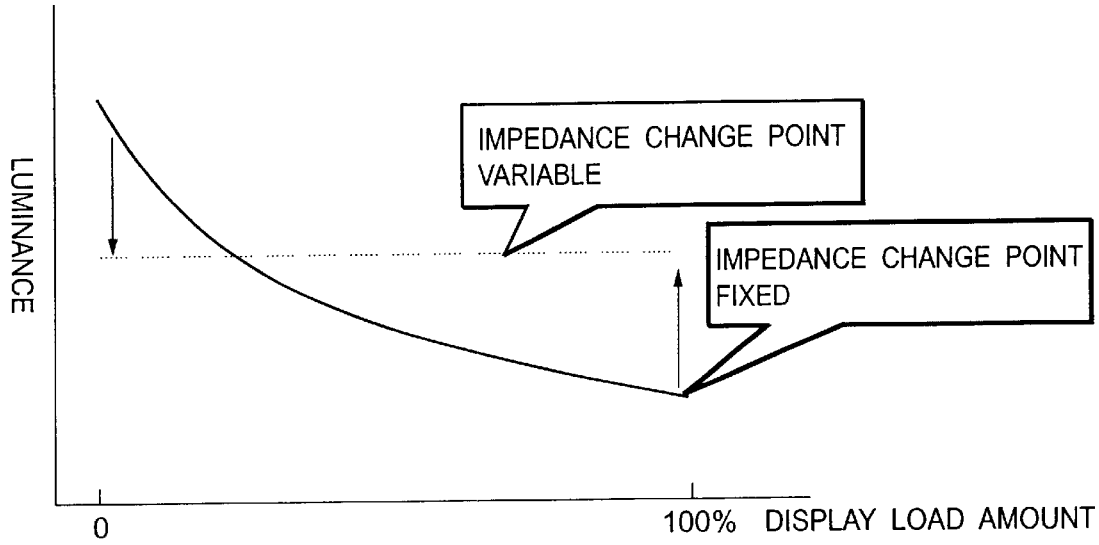
FIG. 14 is a graph showing the dependence of the luminance on the display load amount.
Figure 15:
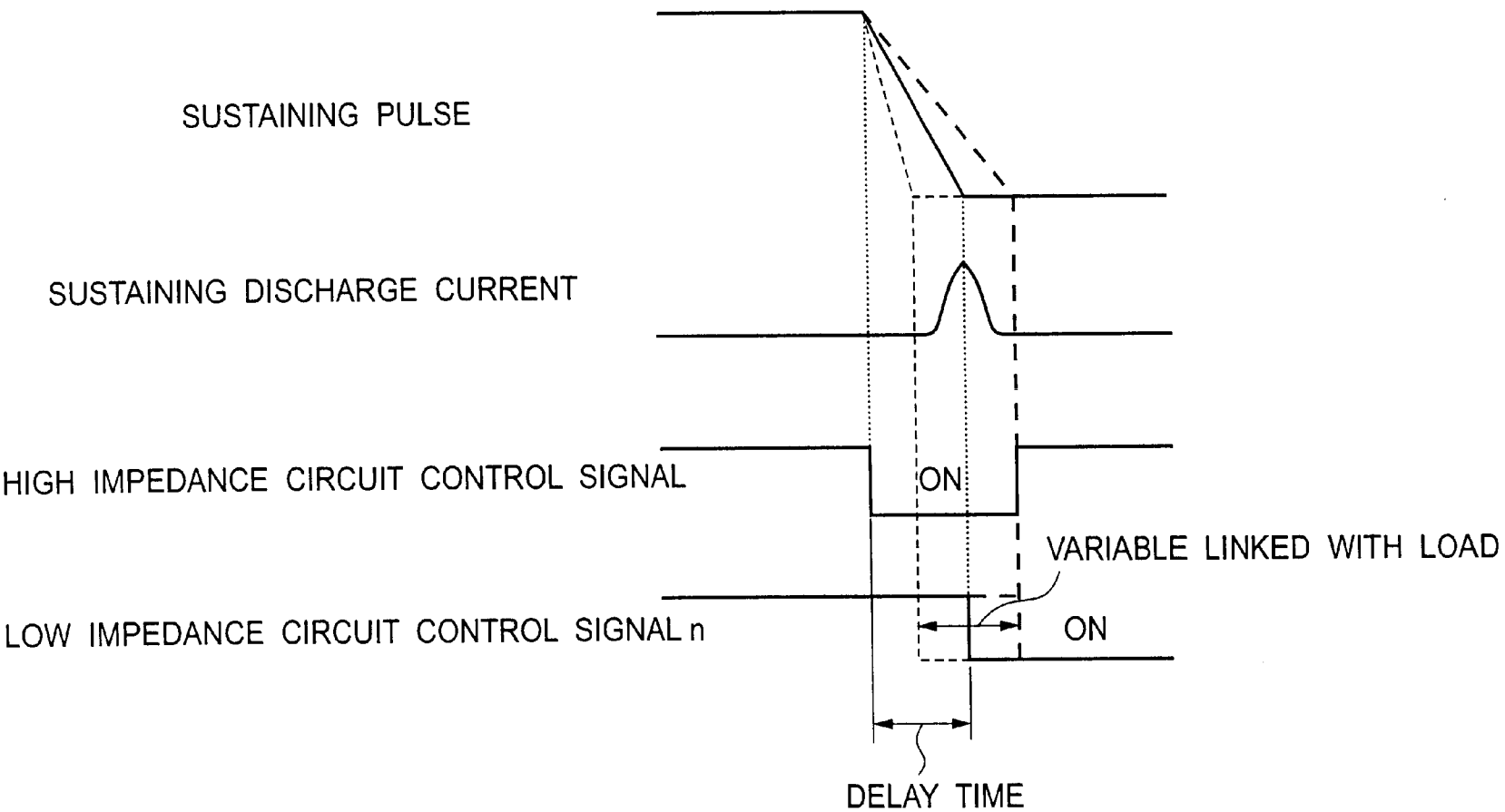
FIG. 15 is a formation diagram of the sustaining pulse waveform for describing the principle of the second mode of embodiment of this invention.
Figure 16:
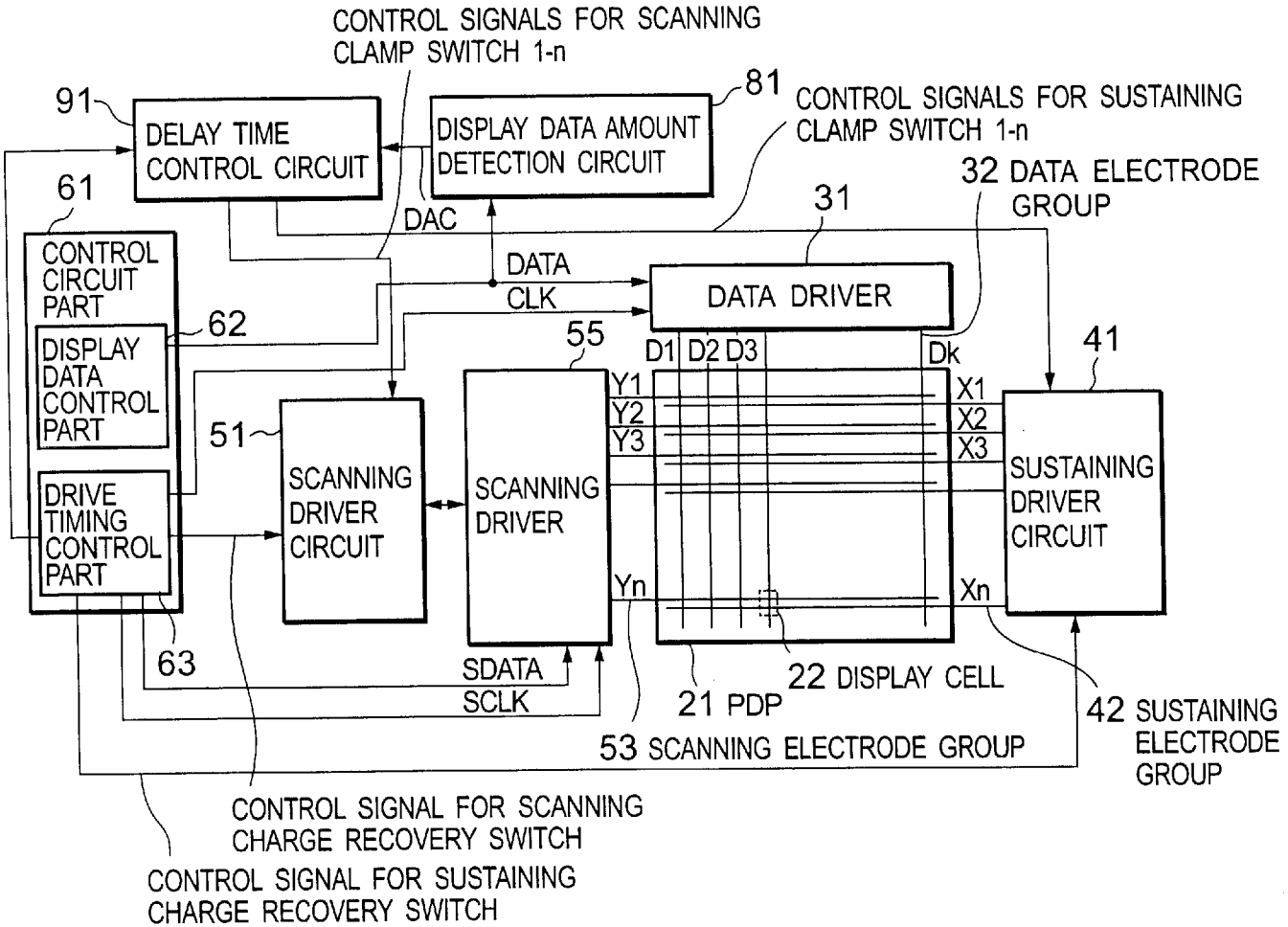
FIG. 16 is a block diagram showing a first embodiment of the second mode of embodiment of this invention.

In the drive unit of the plasma display panel according to a second mode of embodiment of this invention, sustaining electrodes X1, X2, X3, . . . , Xn constituting the sustaining electrode group 42 in the PDP and scanning electrodes Y1, Y2, Y3, . . . , and Yn constituting the scanning electrode group 53 form pairs for respective display lines and are operated independently for respective display lines, as shown in FIG. 16. Display data to be subjected to writing discharge during the writing discharge period in the scanning period are input to a means for detecting the display data, the display data amount subjected to writing discharge are detected for each line, and the detected amount is stored temporarily. Further, at the time of switching the sustaining pulse during the sustaining discharge period, detection amount DAC of the display data amount subjected to writing discharge for each, line which has temporarily been stored is input to a delay time control circuit 91. The outputs of the delay time control circuit 91 are input to a sustaining driver circuit 41 and a scanning driver circuit 51 for performing sustaining discharge, composed of low impedance circuits 47 and high impedance circuits 48, for each electrode as shown in FIG. 13. In this case, when the display data amount (display load amount) is large, the delay time is shortened and voltage drop is suppressed by supplying more sustaining discharge current from the low impedance circuits as shown by the thin broken line in FIG. 15. When the display data amount (display load amount) is small, the delay time is increased to obtain more supply of sustaining discharge current from the high impedance circuits, as shown by the thick broken line in FIG. 15. With this arrangement, it is possible to control the sustaining discharge current to be constant for all lines even if the display data amount (display load amount) is different for different line. By so doing, even if the display data amount (display load amount) subjected to writing discharge varies, the luminance can be corrected as in the broken line in FIG. 14 to minimize the variations in the luminance among the lines.

In the following, referring to the drawings, specific examples of drive unit and drive method of the plasma display panel according to this invention will be described in detail.

First Mode of Embodiment

Embodiment 1

Figure 8:
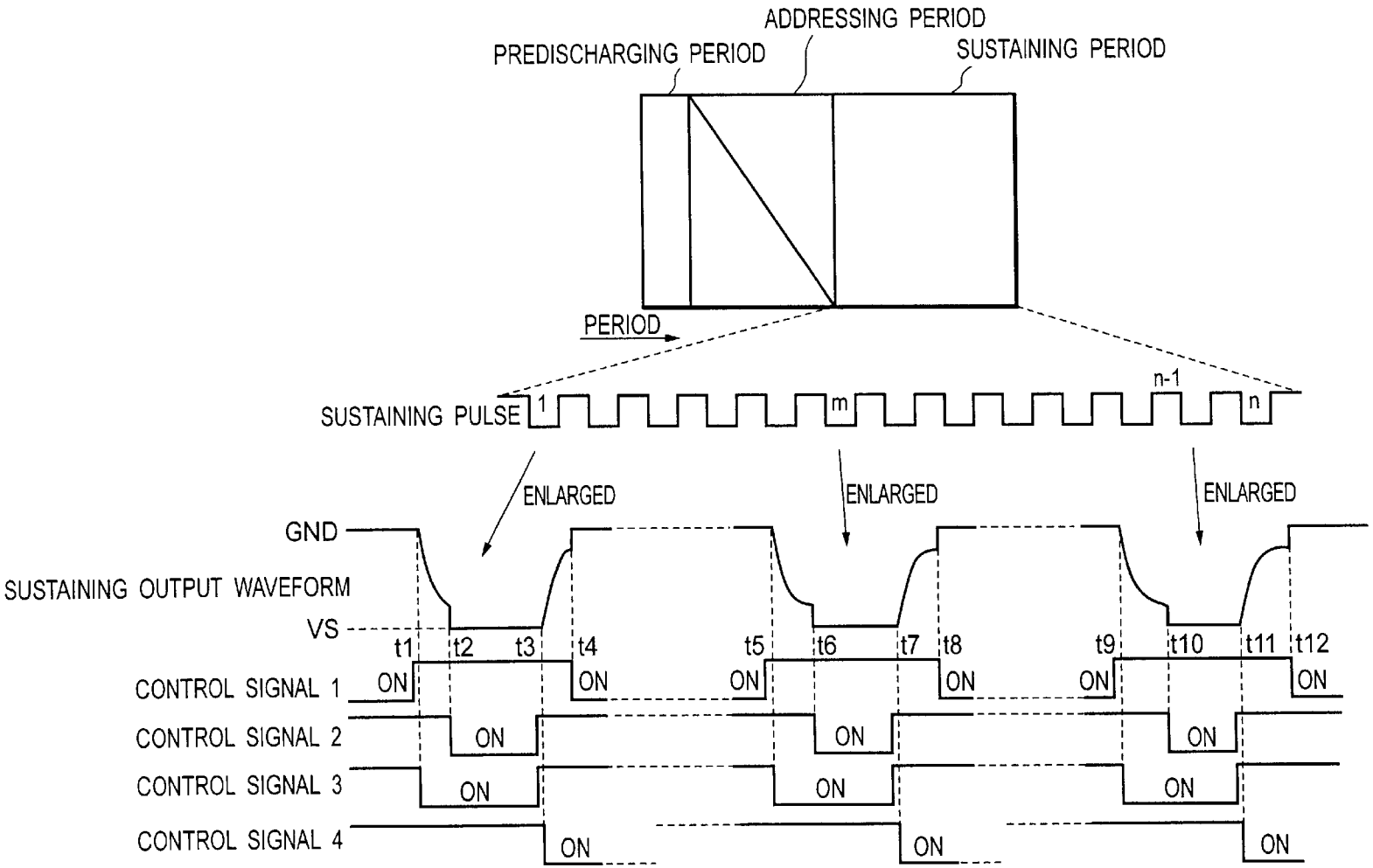
FIG. 8 is a diagram showing the waveform of the sustaining pulse and control timings of various control signals describing the operation of a first mode of embodiment.
Figure 9:
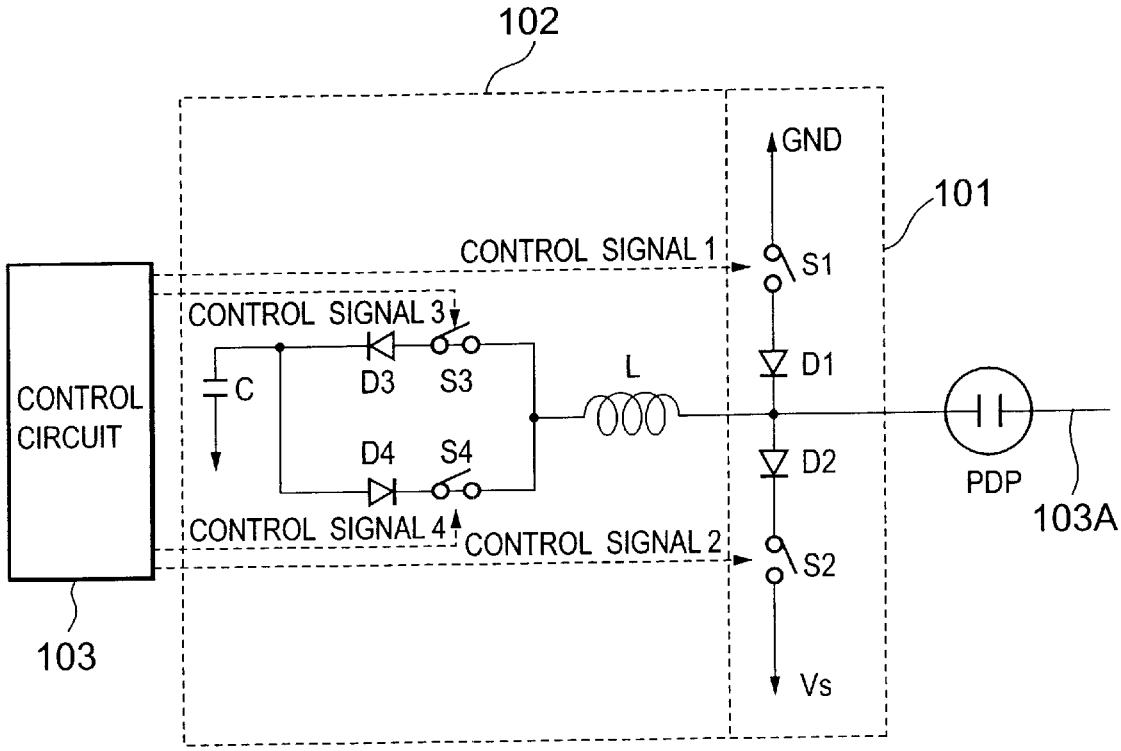
FIG. 9 is a circuit diagram of the main part of a first embodiment of the first mode of embodiment.

FIG. 9 is a circuit diagram showing a specific example of a drive unit and a drive method for the plasma display panel according to this invention, and FIG. 8 is a diagram for describing the operation of the drive unit. These drawings describe a drive method of the plasma display panel which causes a sub-field to luminesce with predetermined gradations using n sustaining pulses. This method is characterized in that the times 51 to t2, t5 to t6, and t9 to t10 describing the times from the start of charge recovery of the sustaining pulses to the fixation to the sustaining potential, and the times t3 to t4, t7 to t8, and t11 to tl2 describing the times to fixation to the ground potential are made variable.

More specifically, FIG. 8 shows a drive method of the plasma display panel in which the time from the start of charge recovery of the sustaining pulse to the fixation to the sustaining potential, and the time to the fixation to the ground potential, are made successively longer from the leading sustaining pulse toward the n-th sustaining pulse.

In the following, the present invention will be described in more detail.

FIG. 8 is a control timing diagram of the sustaining pulses according to a first mode of embodiment of this invention. It illustrates an example in which the times from the start of charge recovery to the clamping to the sustaining potential and to the ground potential, within the sustaining period, are increased with the increase in the arrangement order of the sustaining pulses.

In the schematic diagram in the figure showing the drive timing cycle, first there exists preliminary discharge period in which the entire display cells of the PDP are made to luminesce simultaneously and priming particles necessary for writing are formed, then there exists an addressing period shown by a diagonal. During this period, writing is executed by sequentially applying the writing pulse starting with the leading scanning line of the PDP. After the writing is completed there exists a sustaining period in which the written cells are subjected to sustaining discharge simultaneously. During the sustaining period, sustaining discharge is executed sequentially from the leading toward the n-th sustaining pulse by gradually increasing the times from the start of charge recovery to the clamping to the sustaining potential and to the ground potential. By repeating a series of drive sequences a desired display image can be obtained.

In FIG. 9 is shown a schematic diagram of drive circuit for realizing the first embodiment. The configuration of the figure is roughly classified into a voltage clamping part 101, a charge recovery part 102, and a control circuit 103 for controlling switching elements. The voltage clamping part 101 includes at least a switching element S2 which fixes an output line to a sustaining voltage (VS<0), a switching element S1 which fixes the output line to the ground potential, and diodes D1 and D2 for checking reverse flow of the current. The charge recovery part 102 includes at least switching elements S3 and S4 for allowing the flow of the charging and discharging currents for charge recovery, reverse flow checking diodes D3 and D4 for preventing reverse flow of the currents, a recovery capacitor C for storing charges, and a recovery coil L for resonance.

Next, referring to the schematic diagram of the drive circuit shown in FIG. 9 and the timing chart in FIG. 8, the operation of this embodiment will be described. First, the switching element S3 is turned on by a control signal 3 output from the control circuit 103 at the timing t1, and a charging current is supplied to the recovery capacitor C through the recovery coil L, the switching element S3, and the diode D3 until the time t2.

Since the gas discharge of the PDP requires a delay time of several hundreds of nanoseconds from the application of a voltage, there is no discharge at a time t2 where the recovery operation is completed. Next, the switching element S2 is turned on by a control signal 2 output from the control circuit 103, and the output line is clamped to the sustaining voltage level through the diode D2 during the period up to immediately before a timing t3. After the completion of the clamping, the several hundreds of nanoseconds elapse, and a PDP gas discharge is generated. Since the discharge at this time is one which is generated after a through application of the sustaining voltage, the discharge has a high intensity, and the luminous intensity is also on the high side.

Next, the switching element S4 is turned on at the timing t3 by a control signal 4 output from the control circuit 103, and a discharge current is supplied to the PDP through the recovery capacitor C, the diode D4, the switching element S4, and the recovery coil L. After that, the switching element S1 is turned on by a control signal 1 output from the control circuit 103, and the output line is clamped to the ground potential through the diode D1. At this time, gas discharge is generated since the sustaining pulse at point A in FIG. 9 is clamped to the sustaining potential. This discharge is a strong discharge as in the above.

Generation of the sustaining pulse takes place by repeating the above operation. In this embodiment, however, since the times from the start of charge recovery to the clamping to the sustaining potential and to the ground potential are set to increase gradually in the order of the leading to the n-th sustaining pulse, the effective application voltage during the generation of gas discharge falls gradually, and the intensity itself of the discharge can also be made to decrease gradually.

This invention is particularly effective to a drive system in which the number of the sustaining pulses within the sustaining period is controlled in response to the luminous load amount (namely, a system in which the number of sustaining pulses is small for large load amount, and the number of sustaining pulses is large for small load amount).

Embodiment 2

As a second embodiment of this mode of embodiment, a case in which the control timing chart of the sustaining pulse is given by FIGS. 10 and 11, and the schematic diagram of the drive circuit is given by FIG. 12 will be described.

This example is particularly effective to the case of driving the device by employing a drive system in which the number of the sustaining pulses within the sustaining period is controlled in accordance with the luminous load amount. According to this example, the luminance saturation and the luminance deficiency mentioned above can be further improved. The display load amount is detected from the image signals, the detection result is input to the control circuit which controls the switching elements, and the time from the start of charge recovery of the sustaining pulse to the clamping to the sustaining potential and to the ground potential is made variable in accordance with the detection result. Description on the matters that overlaps with or can readily be analogized from the first embodiment will be omitted.

Figure 10:
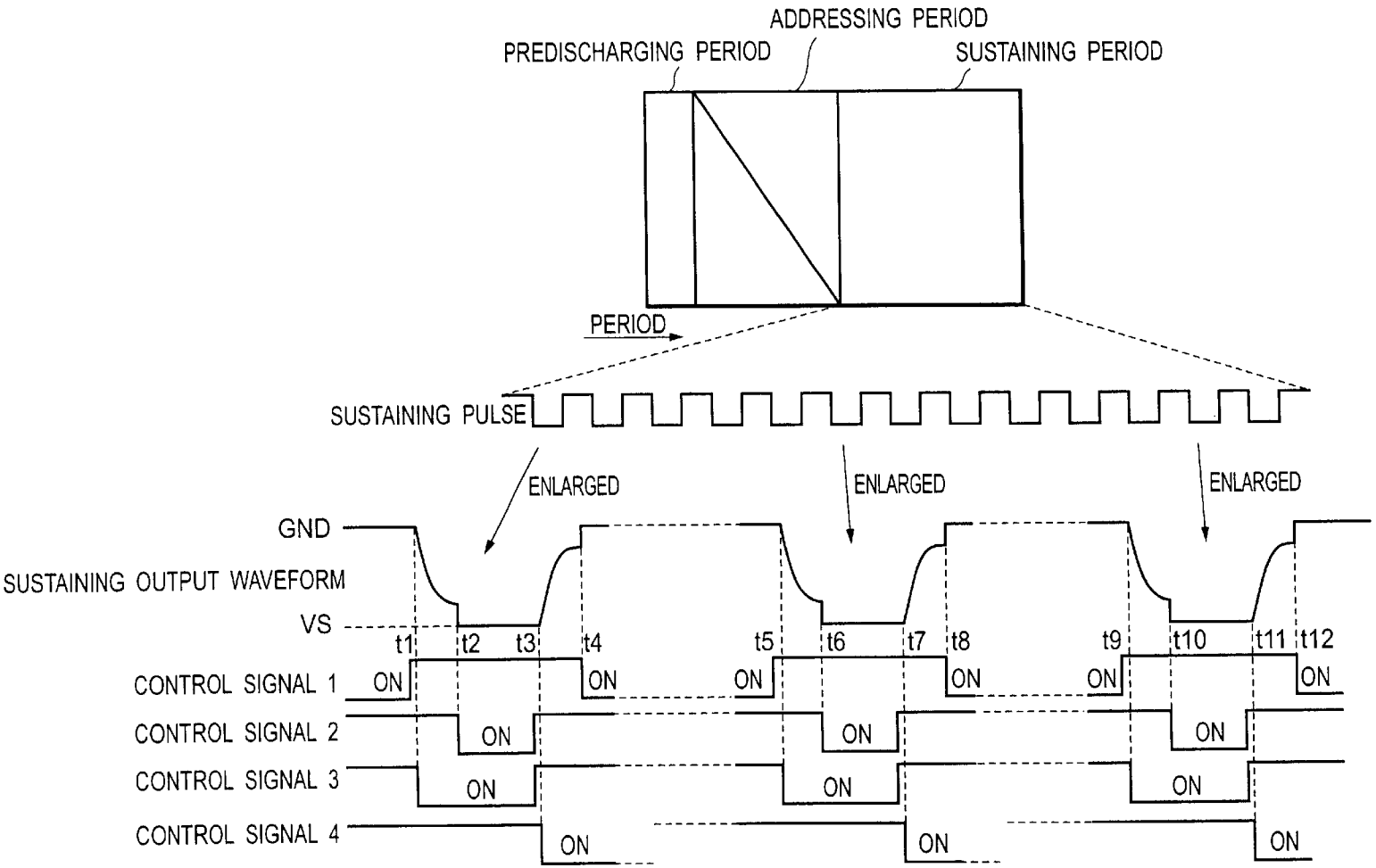
FIG. 10 is a diagram showing the waveform of the sustaining pulse and control timings of various control signals for describing the operation of the case of small display load amount in a second embodiment of the first mode of embodiment.
Figure 11:
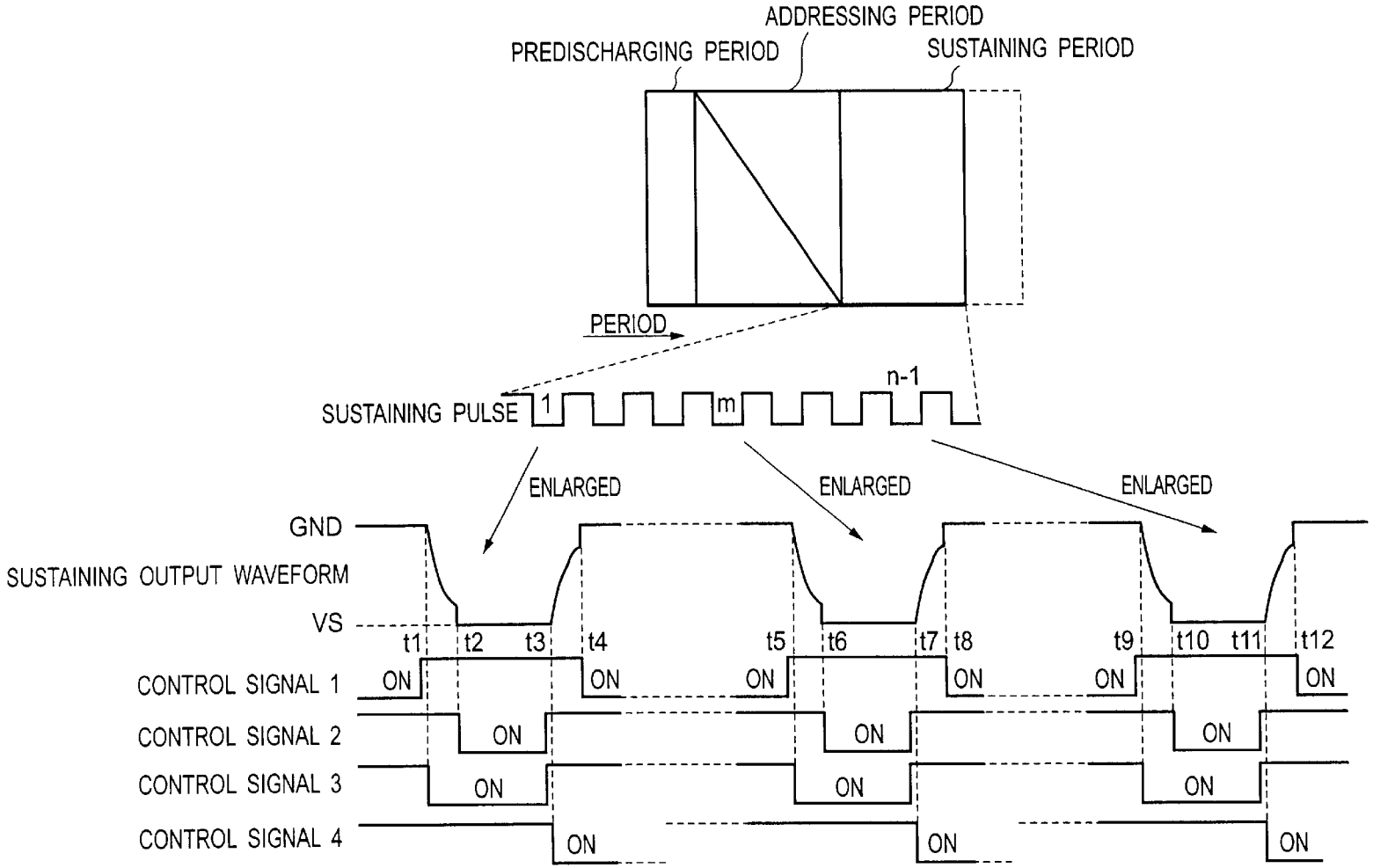
FIG. 11 is a diagram showing the waveform of the sustaining pulse and control timings of various control signals for describing the operation of the case of large display load amount in the second embodiment of the first mode of embodiment.

FIG. 10 is a timing chart for the case where the display load amount in the second embodiment is small, namely, the case where the number of the sustaining pulses is large, in which the times from the start of charge recovery to the clamping to the sustaining potential and to the ground potential are set long. With this arrangement, a drive with low intensity of gaseous discharge and suppression of luminance saturation are possible. On the contrary, when the display load amount is large, namely when the number of the sustaining pulses is small, as shown by a timing chart in FIG. 11, the times from the start of charge recovery to the clamping to the sustaining potential and to the ground potential is set short. With this arrangement, a drive with high intensity of gaseous discharge with sufficient luminous intensity is possible. The timings shown in FIGS. 10 and 11 correspond to both extremities, but it is needless to say that improvement as to the luminance saturation and the luminance deficiency can be enhanced by the drive of the device with setting of a plurality of such timing charts.

Figure 12:
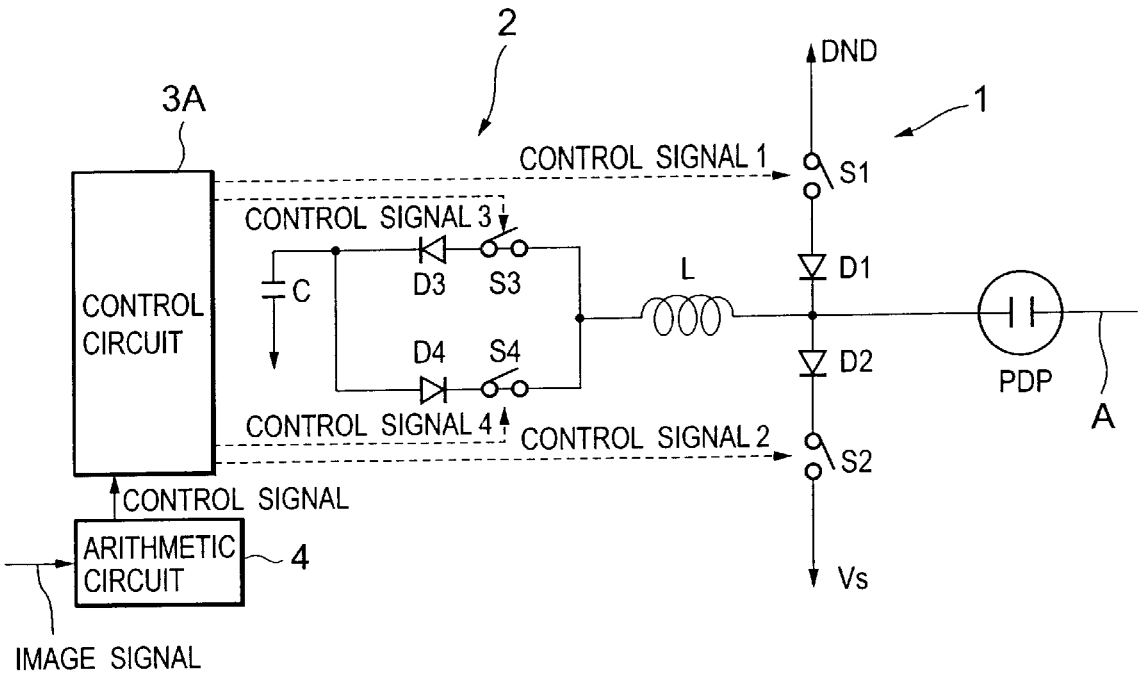
FIG. 12 is a circuit diagram of the main part of the second embodiment of the first mode of embodiment.

Control of respective switching elements in accordance with the display load amount is carried out by an arithmetic circuit 104 and a control circuit 103A in FIG. 12. The arithmetic circuit 104 detects the load amount from input image signals, and outputs a control signal in accordance with the load amount to the control circuit 103A. The control circuit 103A outputs control signals for respective switching elements Si to S4 at timings corresponding to the output signals of the circuit 104.

Second Mode of Embodiment

Embodiment 1

In the following, referring to the drawings, a second mode of embodiment of this invention will be described. In FIG. 16 showing a block diagram of a first embodiment, the PDP 21 is configured by arranging in parallel the sustaining electrodes X1, X2, X3, . . . , Xn constituting the sustaining electrode group 42 and the scanning electrodes Y1, Y2, Y3, . . . , and Yn constituting the scanning electrode group 53, forming pairs for respective display lines. In addition, the data electrodes D1, D2, D3, . . . , and Dk constituting the data electrode group 32 are arranged at opposing positions orthogonally to the electrode pairs of the sustaining electrodes X1, X2, X3, . . . , Xn, and the scanning electrodes Y1, Y2, Y3, . . . , and Yn. A plurality of display cells 22 are arranged in a matrix form at the intersections of the electrode pairs and the data electrodes.

Further, the constitution of the sustaining driver circuit 41, the scanning driver circuit 51, the scanning driver 55, and the data driver 31 which drive the PDP 21, and the constitution of the control circuit part 61 for controlling these circuits will be described.

Figure 17:
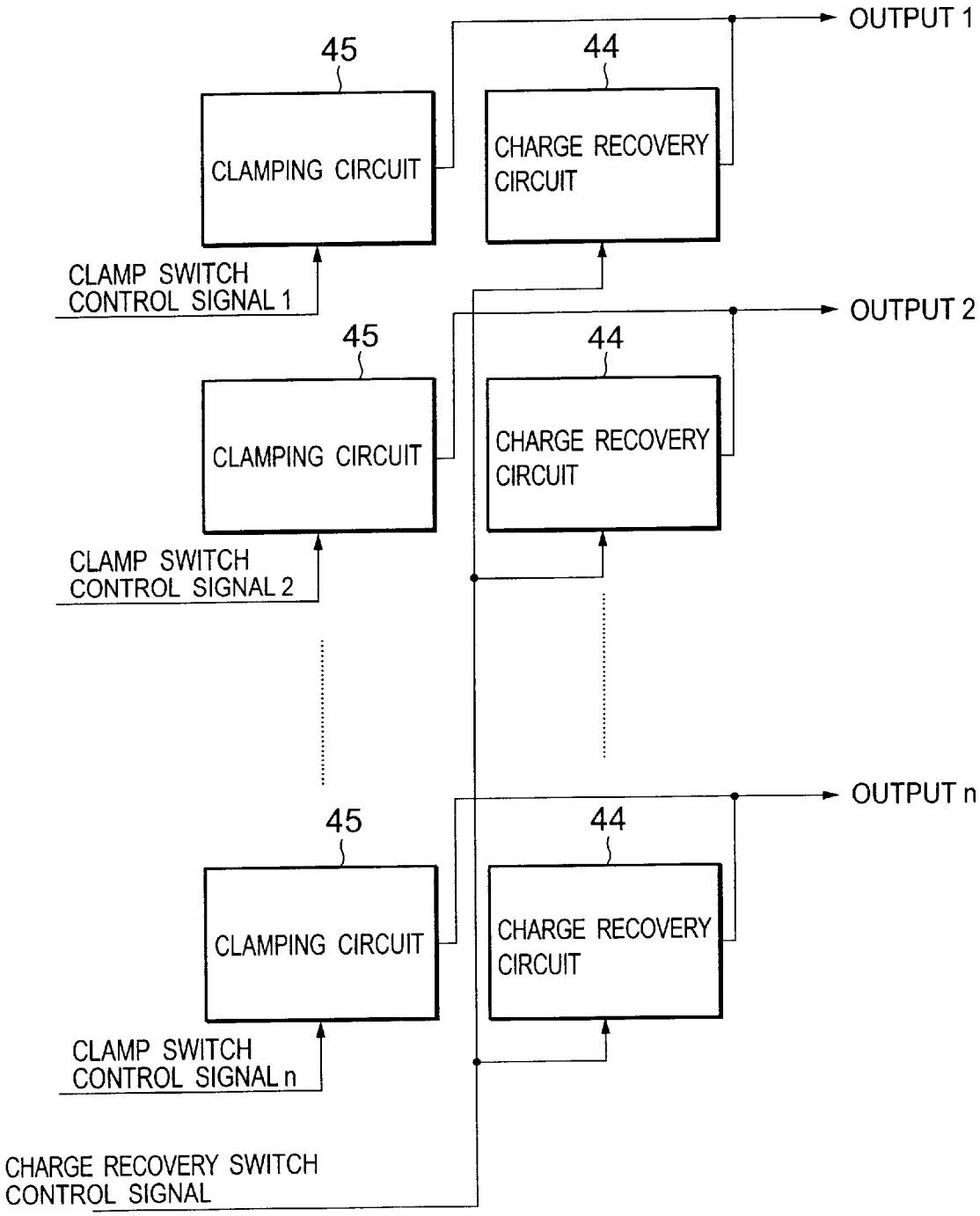
FIG. 17 is an internal block diagram of the sustaining and scanning driver circuits of the first embodiment of the second mode of embodiment of this invention.
Figure 18:
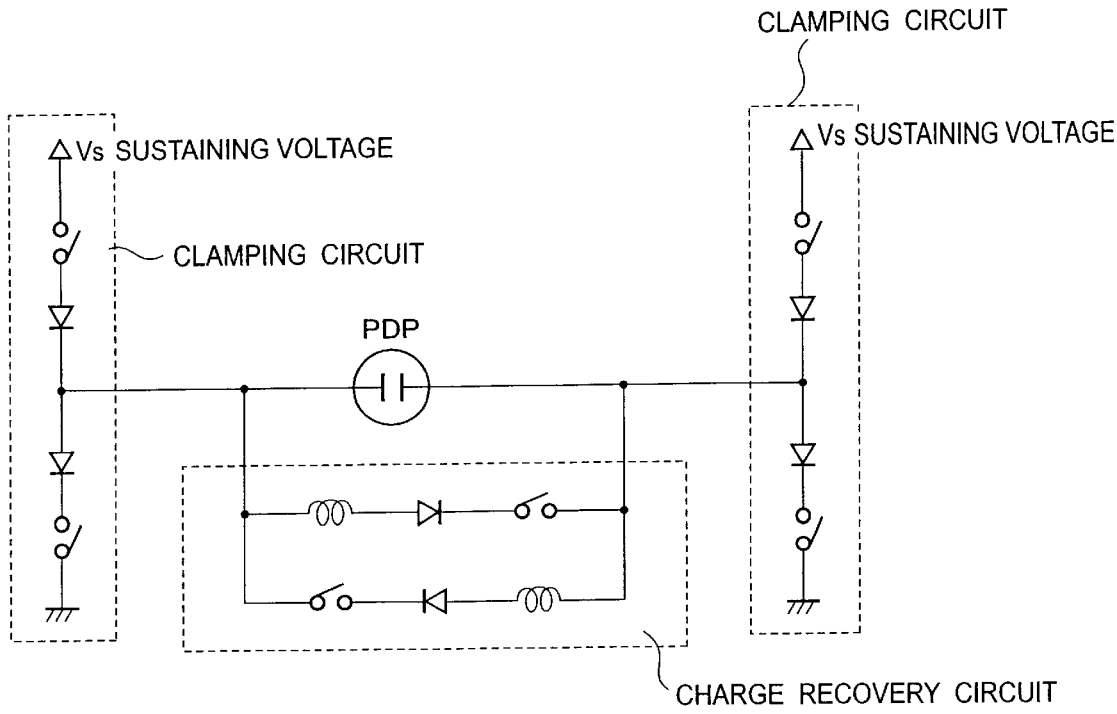
FIG. 18(A) and FIG. 18(B) are circuit diagrams showing specific examples of FIG. 17.
Figure 18:
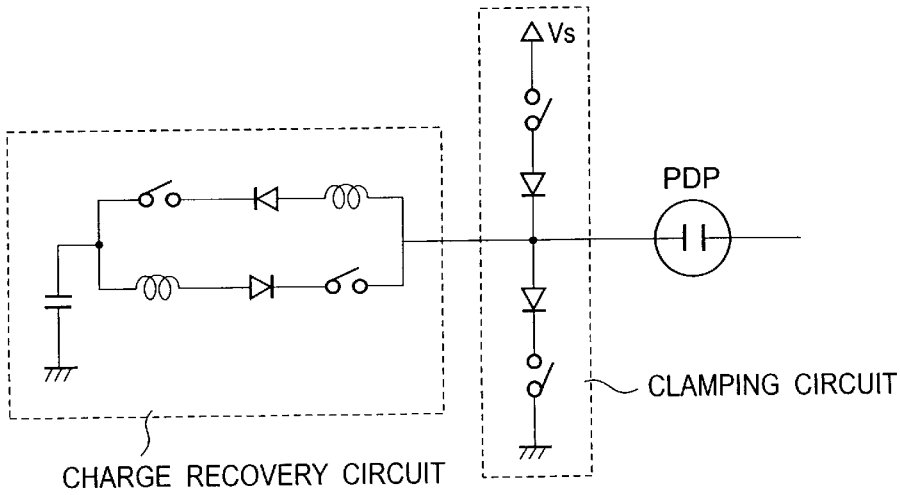

The data driver 31 is provided to drive data of one line portion of the data electrode group 32 for the purpose of carrying out addressing discharge of a plurality of display cells. The sustaining driver circuit 41 is provided to independently carry out sustaining drive for each of the sustaining electrodes X1 to Xn of the sustaining electrode group 42 for the purpose of sustaining discharge of the display cells. The scanning driver circuit 51 is provided for carrying out sequential scanning for display data of one line portion set in the data driver 31 for respective scanning electrodes Y1 to Yn of the scanning electrode group 53 during the scanning period to carry out the selective writing discharge, and carries out sustaining drive independently for respective electrodes when it is shifted to the sustaining discharge period. The sustaining driver circuit 41 and the scanning driver circuit 51 are composed of clamping circuits 45 which are operated independently for respective electrodes and charge recovery circuits 44 which are operated in common for respective electrodes as shown in FIG. 17. Specific examples of FIG. 17 are shown in FIG. 18(A) and FIG. 18(B).

In the clamping circuit, a diode and a switch connected in series to a sustaining voltage VS, and a diode and a switch connected in series to the ground are connected, and the voltage is changed over by means of the switches. In the charge recovery circuit, there are a case where the panel is utilized as a capacitor (FIG. 18(A)) and a case where charge recovery is performed by using a separate capacitor (FIG. 18(B)).

The control circuit part 61 is provided for controlling all the operations of the drive units of the plasma display panel including the data driver 31, the sustaining driver circuit 41, the scanning driver circuit 51, the scanning driver 55 or the like. The main part of the control circuit part 61 is composed of the display data control part 62 and the drive timing control part 63 as in the conventional case. The display data control part 62 has a function of rearranging display data input from the outside to data for driving the PDP 21, and stores temporarily the rearranged display data and transfers them to the data driver 31 as DATA in synchronism with sequential scanning of the,scanning driver 55 during the addressing discharge. The drive timing control part 63 converts various kinds of signal input from the outside such as dot block signal and blanking signal (not shown) into internal control signals for driving the PDP 21. It controls various circuits by outputting data clock CLK to the data driver 31 and scan data SDATA and scan clock SCLK to the scanning driver 55, respectively, and by outputting control signals 1 to n for sustaining clamping switches and a control signal for sustaining power recovery switch to the sustaining driver circuit 41, and control signals 1 to n for scanning clamping switches and a control signal for scanning power recovery switch to the scanning driver circuit 51.

Figure 20:
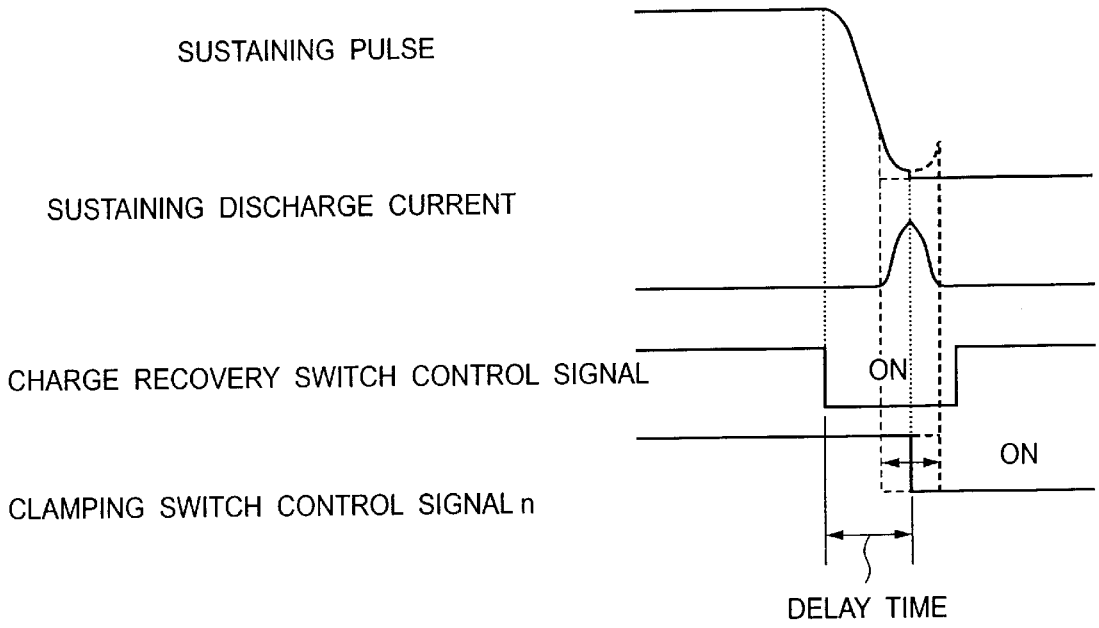
FIG. 20 is an enlarged diagram of part A in FIG. 19 for the case of the first embodiment of the second mode of embodiment of this invention.

Moreover, the display data DATA output from the display data control part 62 are also input to a display data amount detection circuit 81 which is a feature of this invention, to detect for each line the display data amount performing writing discharge during the writing discharge period and outputs the detected value DAC. The detected value DAC is input to the delay time control circuit 91, and when the detected value changes, controls the delay time from turn-on of the control signal for charge recovery switch to turn-on of the control signal n for clamping switch as shown in FIG. 20. When the display data amount (display load amount) is large, the delay time is shortened as shown by the thin broken line to suppress the voltage drop by receiving more supply of the sustaining discharge current from the clamping circuits with low impedance. On the contrary, when the display data amount (display load amount) is small, the delay time is increased as shown by the thick broken line to receive more sustaining discharge current from charge recovery circuits with high impedance. In this way, even if the display data amount (display load amount) changes, it is possible to control so as to obtain a constant sustaining current for each line. With this arrangement, even if the display data amount (display load amount) performing writing discharge varies, the luminance is corrected ads shown by the broken line in FIG. 14 to reduce the variations in the luminance among the lines, and it is possible to faithfully display the gradations of display data and obtain an excellent display quality.

Figure 1:
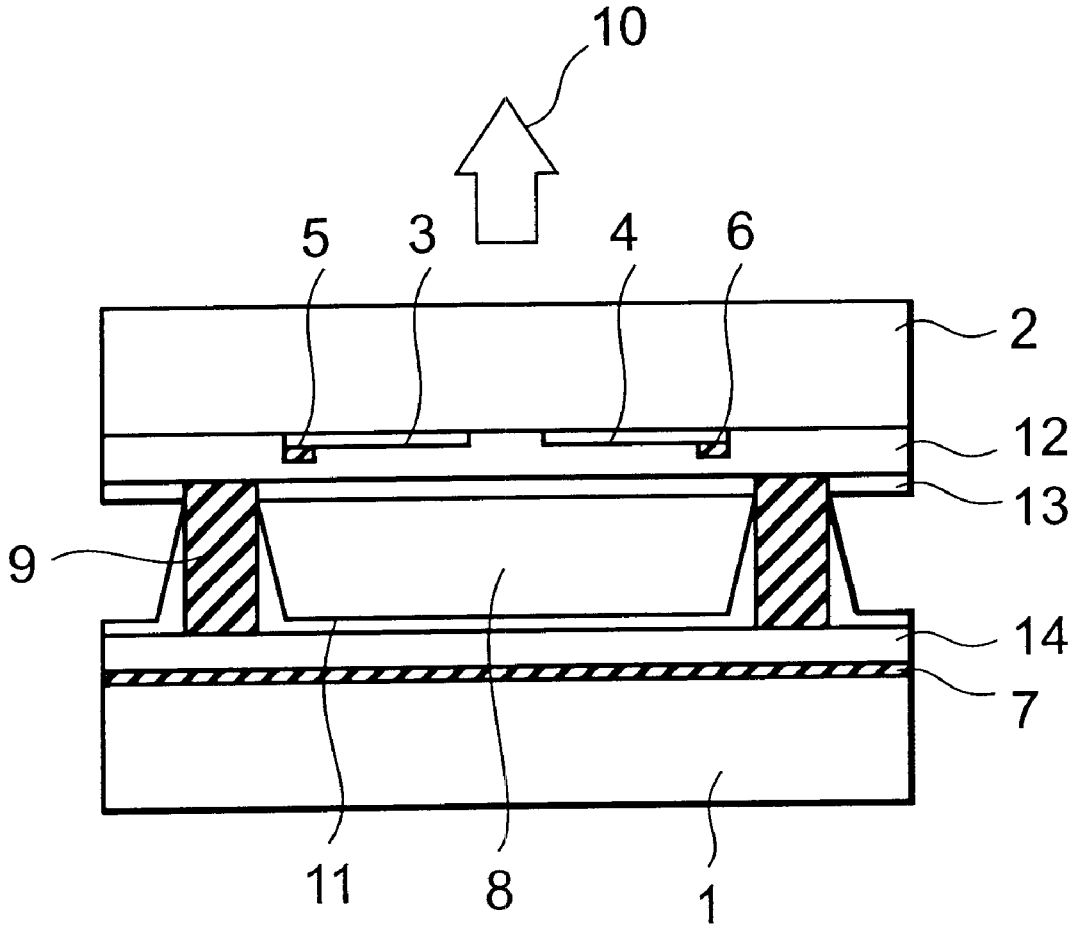
Fig.1 (Prior Art)
FIG. 1 is sectional view of a PDP.
Figure 2:
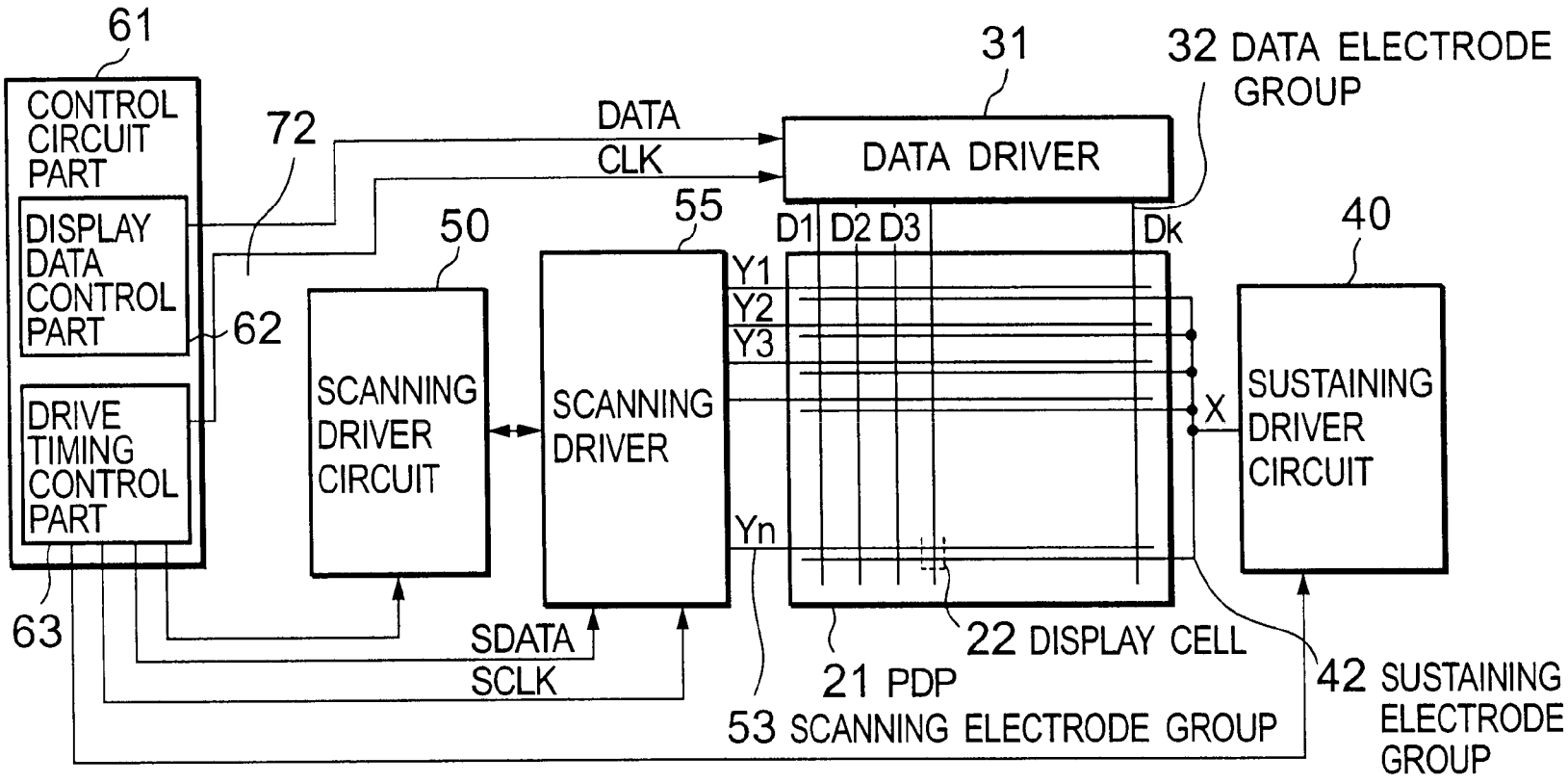
Fig.2 (Prior Art)
FIG. 2 is a block diagram of a conventional PDP drive unit.
Figure 3:
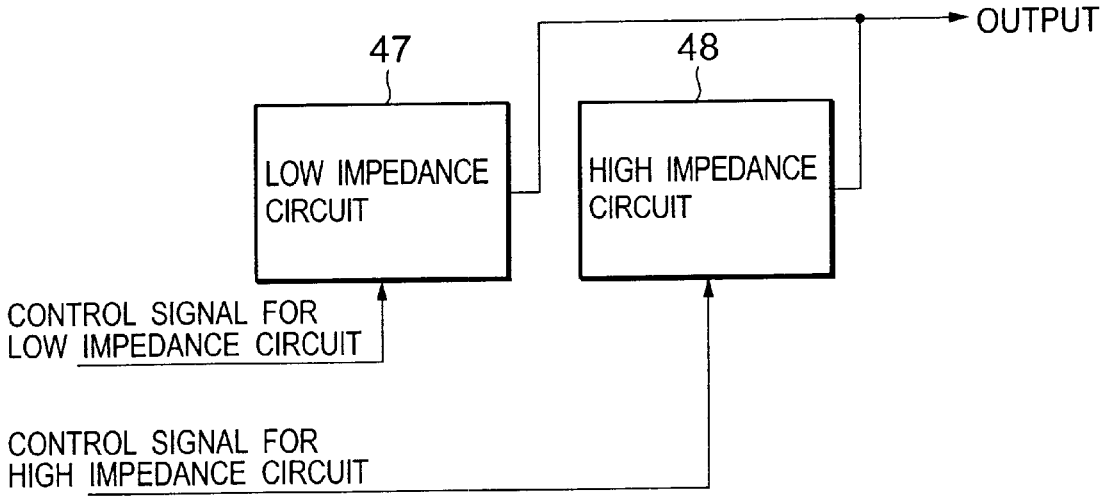
Fig.3 (Prior Art)
FIG. 3 is an internal block diagram of conventional sustaining and scanning driver circuits.
Figure 4:
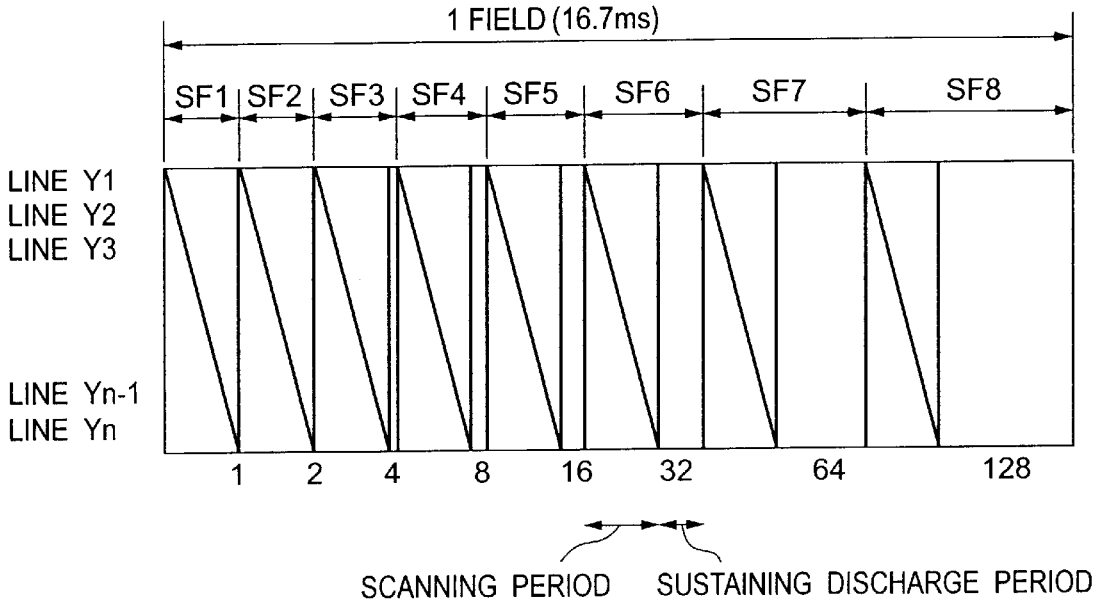
Fig.4 (Prior Art)
FIG. 4 is a diagram showing the formation of a plurality of sub-fields.
Figure 5:
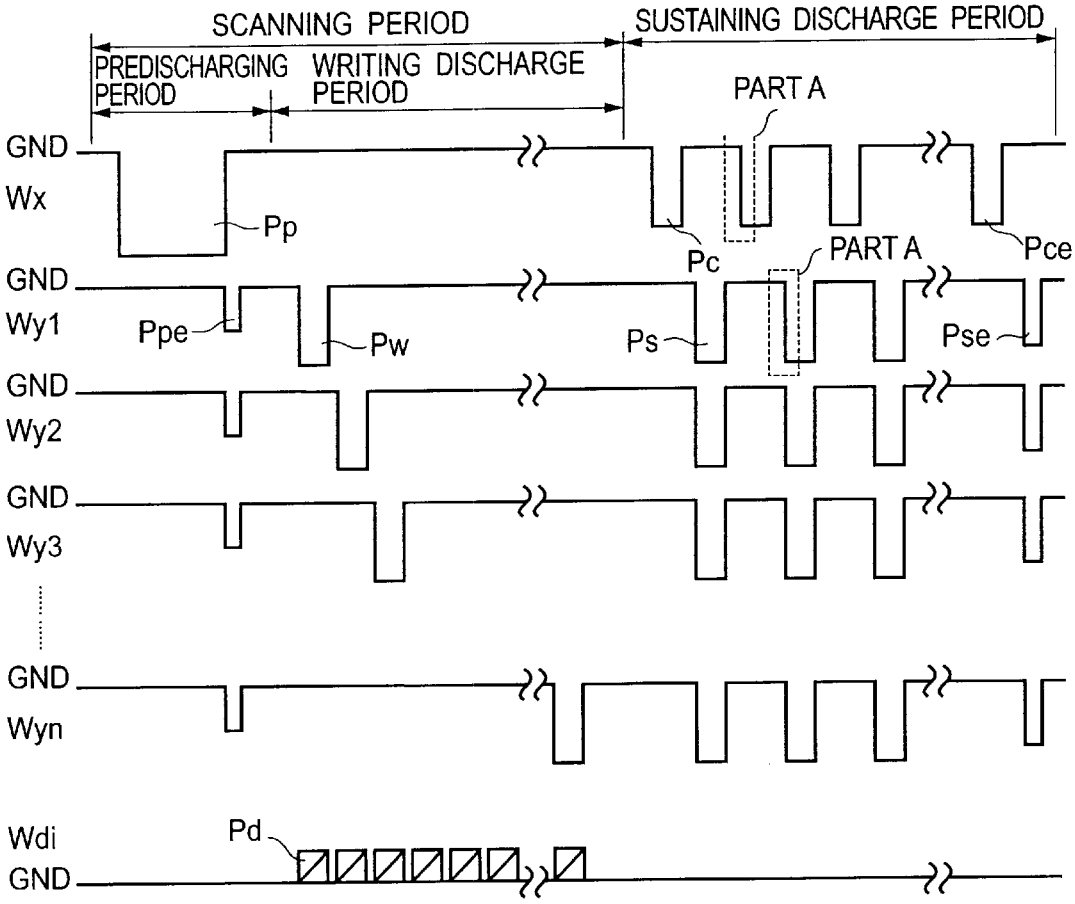
Fig.5 (Prior Art)
FIG. 5 is a detailed diagram of a conventional sub-field.
Figure 6:
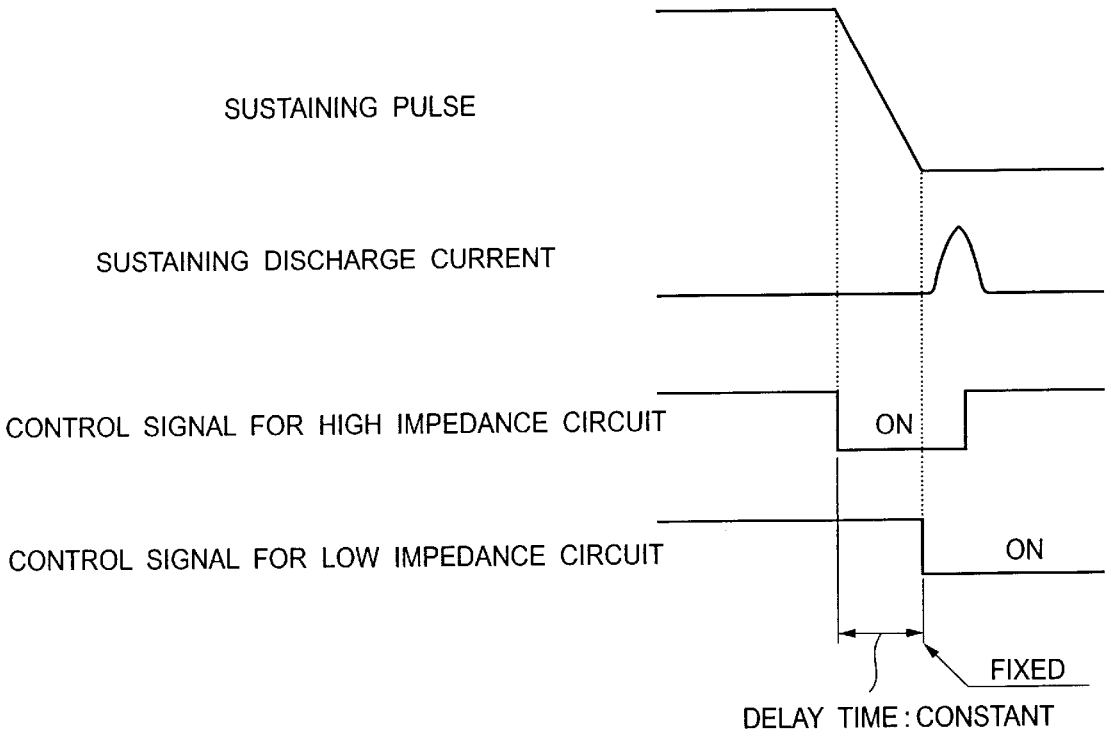
Fig.6 (Prior Art)
FIG. 6 is an enlarged diagram of part A in FIG. 5 of the conventional case.

Next, the drive sequence will be described. Analogous to the conventional device, a plurality of sub-fields for the drive unit of the PDP are formed as shown in FIG. 4. For example, a field having a period of 16.7 ms is divided into 8 sub-fields, and by regulating the drive sequence through appropriate combination of these sub-fields display of 256 gradations is realized. Each sub-field consists of a scanning period for carrying out writing of display data in accordance with the weight of the sub-field, and a sustaining discharge period for displaying display data which are designated for writing, and an image for one field is displayed by superposing these sub-fields.

Figure 19:
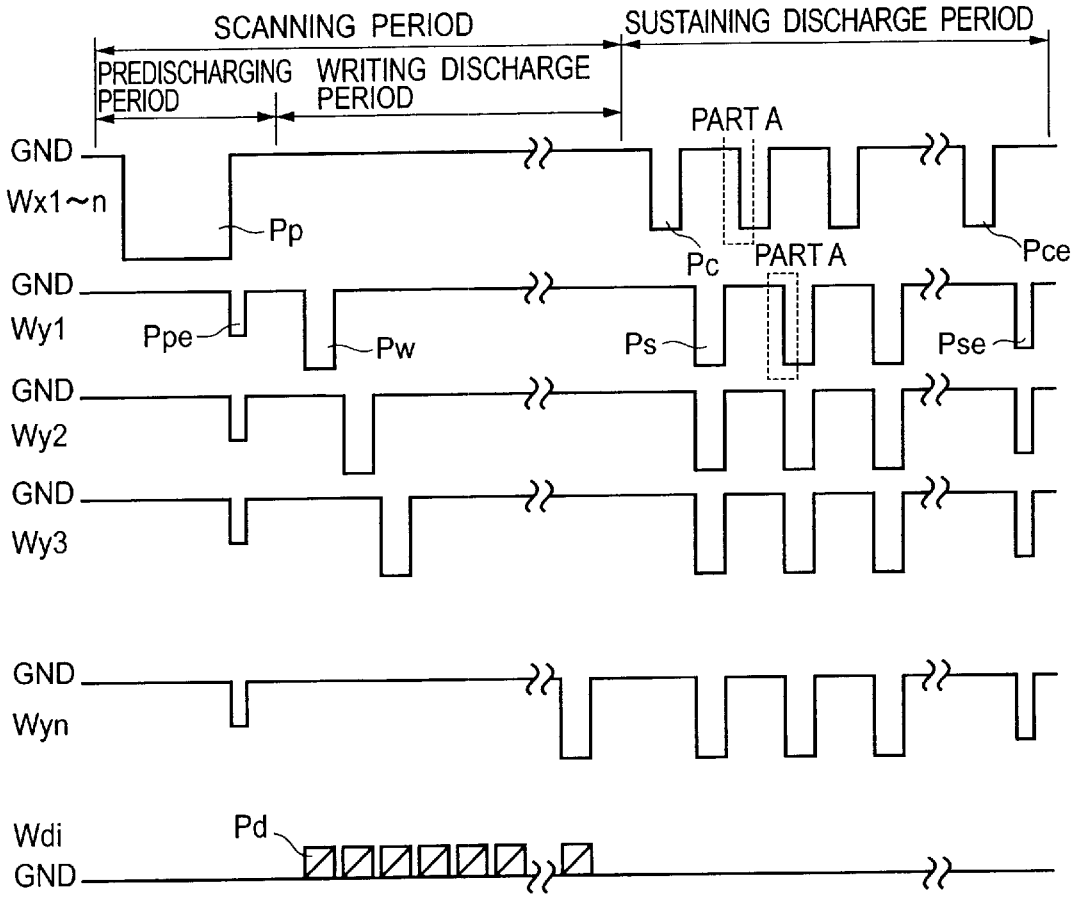
FIG. 19 is a detailed diagram of a sub-field of the second mode of embodiment of this invention.

FIG. 19 is a detailed diagram showing a sub-field having a certain weight. It shows a sustaining electrode driving waveform Wx1–n applied in common to the sustaining electrodes X1 to Xn, scanning electrode driving waveforms Wy1 to Wyn applied to the scanning electrodes Y1 to Yn, and data electrode driving waveform Wdi (1□i□k) applied to the data electrodes D1 to Dk. One cycle of the sub-field consists of a scanning period and a sustaining discharge period, where the scanning period is divided into a preliminary discharge period and a writing discharge period, and a desired image display is obtained by repeating this combination. Here, the preliminary discharge period is adopted as needed and may be omitted.

The preliminary discharge period is the period for generating active particles and wall charges within the discharging gas space in order to obtain stable writing discharge during the writing discharge period. During this period there are supplied a preliminary discharge pulse Pp which causes simultaneous discharge of all display cells of the PDP, and a preliminary discharge erasing pulse Ppe for eliminating charges which hinder writing discharge and sustaining discharge among wall charges generated by the application of the preliminary discharge pulse Pp.

The sustaining discharge period is the period for causing the display cell, which underwent writing discharge in the writing discharge period, to go through sustaining discharge and luminesce in order to obtain a desired luminance.

During the preliminary discharge period, first, the preliminary discharge pulse Pp is applied to the sustaining electrodes X1 to Xn to cause discharge in all display cells. Then, erasing discharge is generated in the scanning electrodes Y1 to Yn by applying the preliminary discharge erasing pulse Ppe to eliminate the wall charges accumulated by the preliminary discharge pulse Pp.

Following that, during the writing discharge period, a scanning pulse Pw is applied to the scanning electrodes Y1 to Yn in line sequence, and a data pulse Pd is applied selectively to the data electrode Di (1□i□k) corresponding to image display data, and a writing discharge is generated in a cell to be displayed to form wall charges. At this time, the display data amount for each line to be subjected to writing discharge is detected by a display data amount detection circuit 81, and it is stored temporarily until the sustaining discharge period.

Then, during the sustaining discharge period, only the display cells which underwent writing discharge are subjected to consecutive sustaining discharge by sustaining pulses Pc and Ps. After the final sustaining discharge is performed by the final sustaining pulse Pce, the wall charges formed are eliminated by a sustaining discharge erasing pulse Pse to terminate the sustaining discharge, completing luminescence operation for one image screen. At this time, as shown in FIG. 19, the sustaining pulses Pc and Ps are generated by a control signal for charge recovery switch and a control signal n for clamping switch, and the detected display data amount DAC which has been temporarily stored is input to the delay time control circuit 91. By controlling the delay time from the turn-on of the control signal for power recovery switch to the turn-on of the control signal n for clamping switch for each line in accordance with the detected display data amount DAC, a predetermined sustaining discharge current is made to flow in each line. With this arrangement, even if there is a change in the display data amount (display load amount), the luminance can be corrected as shown by the broken line in FIG. 14, variations in the luminance among lines can be minimized, gradations of data can be displayed faithfully, and an excellent display quality can be obtained.

Embodiment 2

Figure 21:
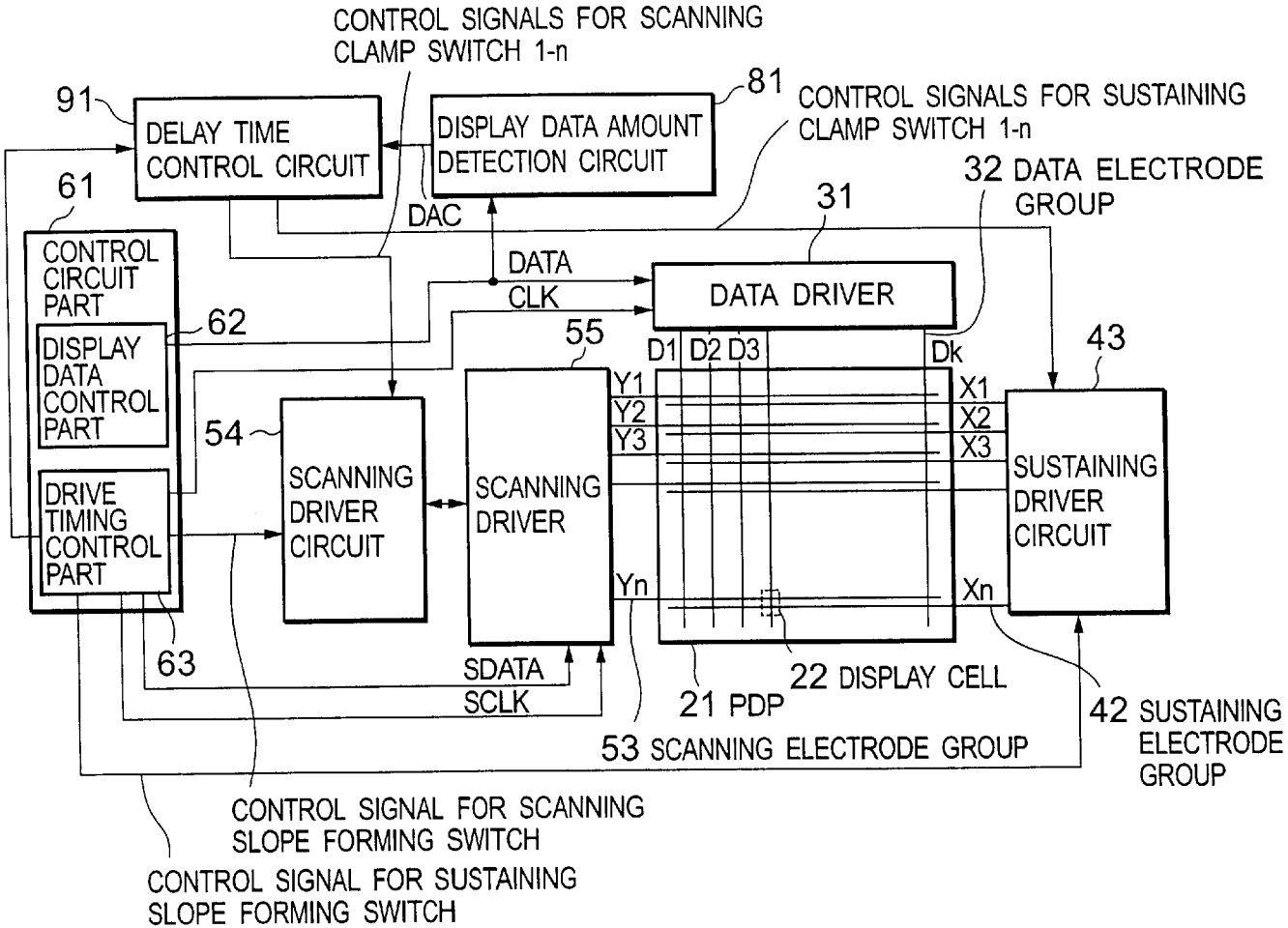
FIG. 21 is a block diagram showing a second embodiment of the second mode of embodiment of this invention.

FIG. 21 is a block diagram showing the configuration of a second embodiment of the second mode of embodiment. In the PDP 21, sustaining electrodes X1, X2, X3, . . . , and Xn constituting a sustaining electrode group 42, and scanning electrodes Y1, Y2, Y3, . . . , Yn constituting scanning electrode group 53 are arranged in parallel for each display line. Further, data electrodes D1, D2, D3, . . . , and Dk constituting a data electrode group 32 are arranged orthogonally in opposing positions to the electrode pairs of the sustaining electrodes X1, X2, X3, . . . , and Xn and the scanning electrodes Y1, Y2, Y3, . . . , and Yn. A plurality of display cells 22 are formed at the intersections of these electrode pairs and the data electrodes in a matrix form.

Moreover, the configurations of a sustaining driver circuit 43 and a scanning driver circuit 54, the scanning driver 55, and the data driver 31, and the configuration of the control circuit part 61 for controlling these driver circuits and the drivers will be described.

Analogous to the conventional case, the data driver 31 for performing data drive of one line portion of the data electrode group 32 is provided for the purpose of addressing discharge of the plurality of display cells. The sustaining driver circuit 43 is provided to carry out independent sustaining drive for each electrode of the sustaining electrodes X1 to Xn of the sustaining electrode group 42 for the purpose of sustaining discharge of the display cell 22. Further, the scanning driver circuit 54 is provided for performing sequential scanning for one line portion of display data set in the data driver for each of the scanning electrodes Y1 to Yn of the scanning electrode group 53 during the scanning period for performing selective writing discharge, and carrying out sustaining drive independently for each electrode when it is shifted to the sustaining discharge period. The sustaining driver circuit 43 and the scanning driver circuit 54 are composed of clamping circuits 45 which operate independently for each electrode and sloping forming circuits 46 in which all the electrodes operate in common as shown in FIG. 22.

Figure 22:
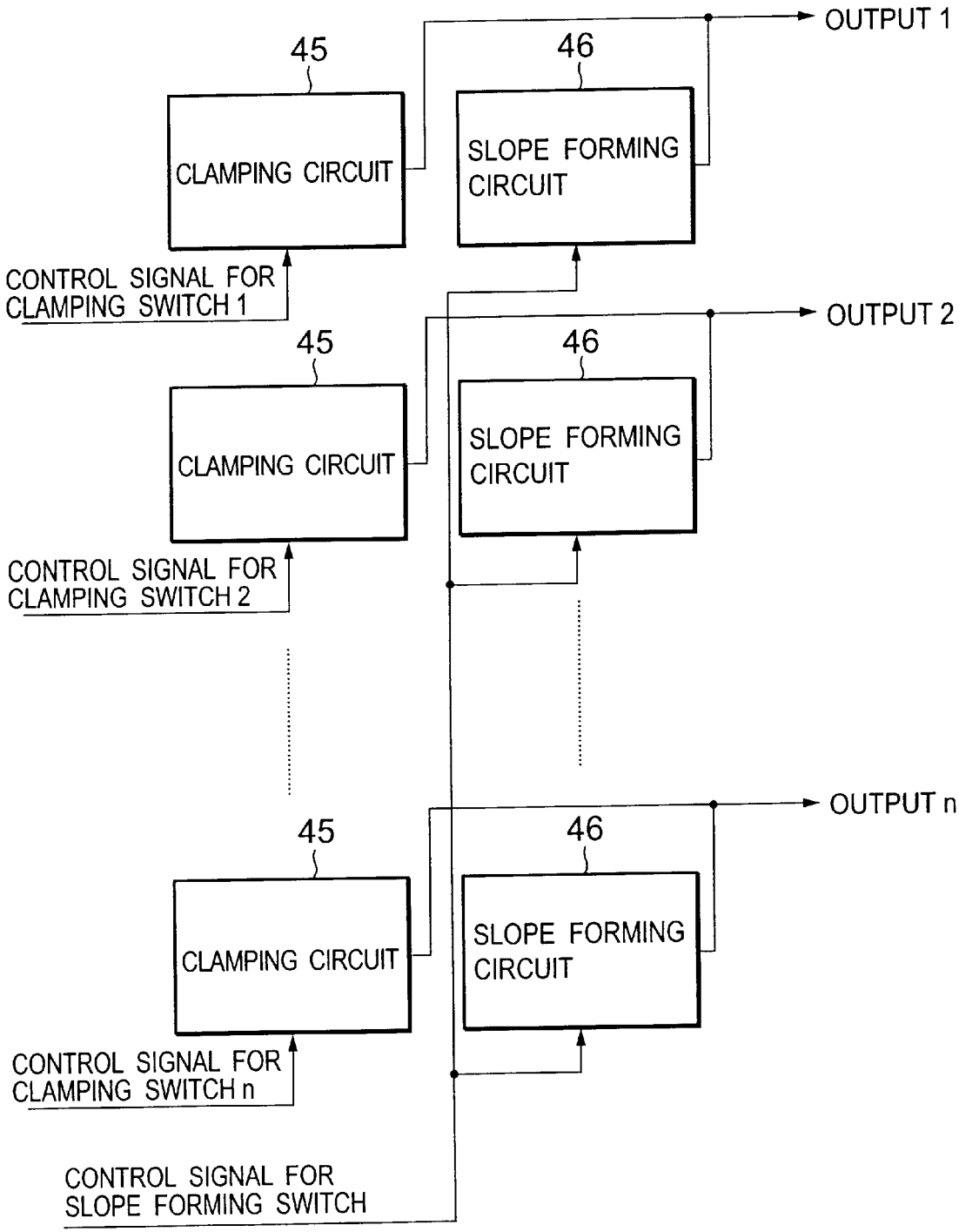
FIG. 22 is an internal block diagram of the sustaining and scanning driver circuits of the second embodiment of the second mode of embodiment of this invention.
Figure 23:
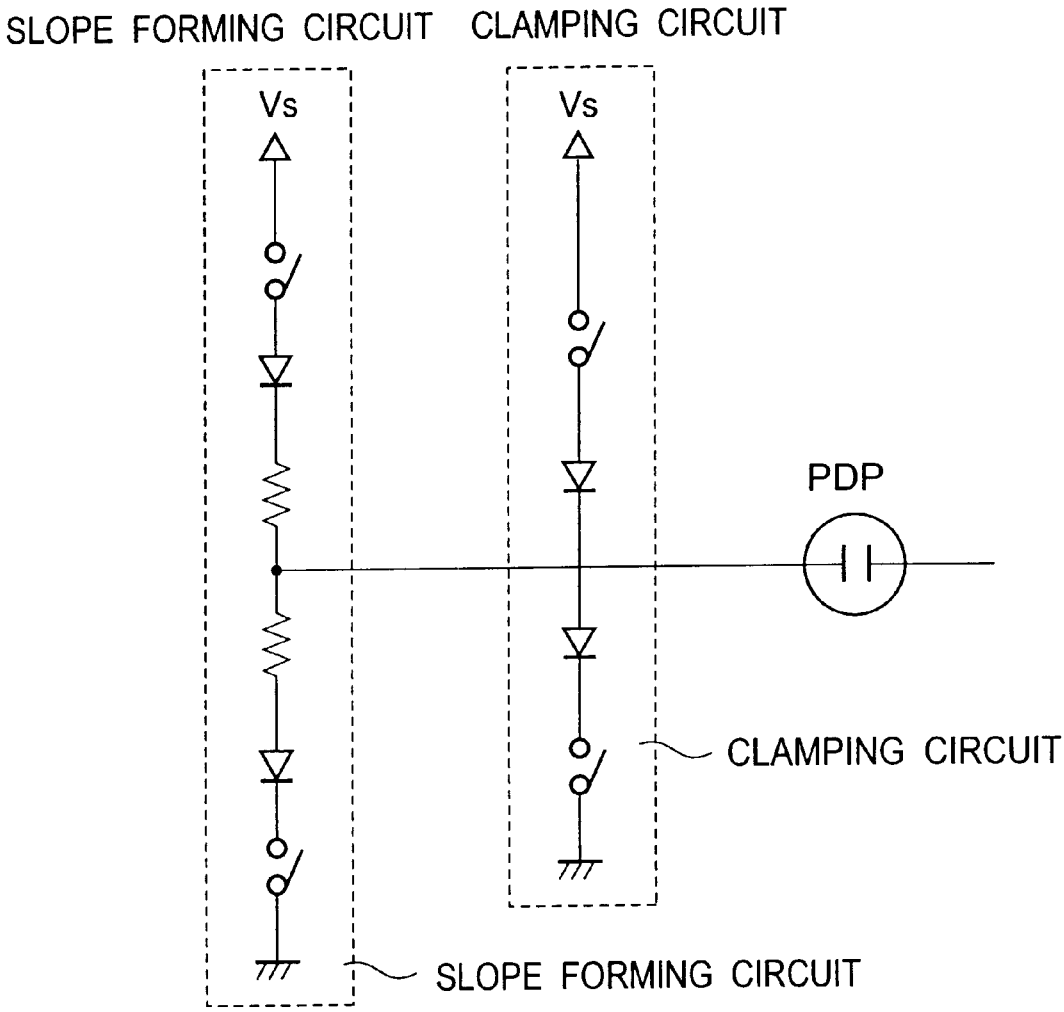
FIG. 23 is a circuit diagram showing a specific example of FIG. 22.

A specific example of the circuits in FIG. 22 is illustrated in FIG. 23. The clamping circuit is the same as in FIG. 18(A), and the slope forming circuit is obtained by connecting a series connection of a diode, a switch, and a resistor to the sustaining voltage VS and a series connection of a diode, a switch, and a resistor connected to the ground potential, and the connection to the voltage VS and to the ground potential is changed over by the switches.

Further, the control circuit part 61 is provided for controlling all the operations of the drive units of the plasma display panel including the data driver 31, the sustaining driver circuit 43, the scanning driver circuit 54, the scanning driver 55 or the like. The main part of the control circuit part 61 is composed of the display data control part 62 and the drive timing control part 63 analogous to the conventional device. The display data control part 62 has the function of rearranging display data input from the outside to data for driving the PDP 21, and stores temporarily the rearranged display data stream and transfers the stored data to the data driver 31 as display data DATA in synchronism with the sequential scanning during the addressing discharge. The drive timing control part 63 converts various kinds of signal (not shown) such as a dot clock and a blanking signal input from the outside to internal control signals for driving the PDP 21. The data clock CLK is output to the data drive 31 and the scanning data SDATA and the scanning clock SCLK are output to the scanning driver 55, and the device is controlled by outputting control signals 1 to n for sustaining clamping switches and signals for sustaining slope forming switches to the sustaining driver circuit 43, and control signals 1 to n for scanning clamping switches and signals for scanning slope forming switches to the scanning driver circuit 54.

Figure 24:
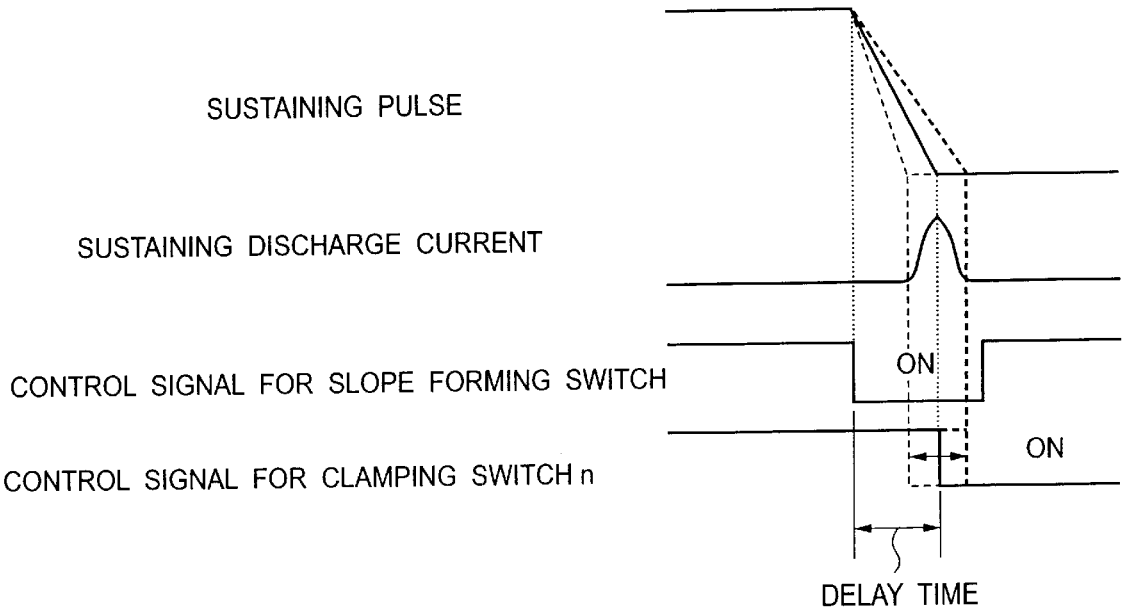
FIG. 24 is an enlarged diagram of part A in FIG. 19 of the second embodiment of the second mode of embodiment of this invention.

Moreover, the display data DATA output from the display data control part 62 are also input to the display data amount detection circuit 81 which is a feature of this invention. The display data amount detection circuit 81 detects the display data amount performing writing discharge for each line in the writing discharge period during the scanning period, and outputs the detection amount DAC. The detection amount DAC is input to the delay time control circuit 91, and when the detection value changes, it controls the time from the turn-on of the control signal for slope forming signal to the turn-on of the control signal for clamping switch as shown in FIG. 24. When the display data amount (display load amount) is large, the delay time is shortened as shown by the thin broken line to suppress the voltage drop by inducing more supply of the sustaining discharge current from the low impedance circuits. When the display data amount (display load amount) is small, by increasing the delay time as shown by the thick broken line in the figure to induce more supply of the sustaining discharge current from the slope forming circuits with high impedance. Thus, it is possible to control the device to have a constant sustaining discharge current for all lines even if the display data amount (display load amount) varies from one line to another. In this way, even if there are changes in the display data amount (display load amount) which perform writing discharge, the luminance can be corrected as shown by the broken line in FIG. 14 to reduce the variations in the luminance among the lines, faithful display of the gradations of the display data can be attained, and an excellent display quality can,be obtained.

Next, the drive sequence will be described. One field of the drive unit of the PDP is divided into a plurality of sub-fields in the same way as in the conventional device shown in FIG. 4. For example, one field having a period of 16.7 ms is divided into 8 sub-fields. By regulating the drive sequence through an appropriate combination of these sub-fields, display of the 256 gradations is realized. Each sub-field is divided, in accordance with the weight of the sub-field, into a scanning period which performs writing of display data, and a sustaining discharge period which displays display data designated for writing. An image for one field is displayed by the superposition of these sub-fields.

FIG. 19 is a diagram showing the details of a sub-field with a certain weight. It shows the sustaining electrode driving waveform Wx1–n applied in common to the sustaining electrodes X1 to Xn, the scanning electrode driving waveforms Wy1 to Wyn applied to the scanning electrodes Y1 to Yn, and the data electrode driving waveforms Wdi (1□i□k) applied to the data electrodes D1 to Dk. One cycle of the sub-field consists of the scanning period and the sustaining discharge period, where the scanning period consists of the preliminary discharge period and the writing discharge period, and a desired image is obtained by repeating these periods. The preliminary discharge period is adopted as needed, and may be omitted.

The preliminary discharge period is the-period for generating active particles and wall charges within the discharge gas space in order to obtain a stabilized writing discharge during the writing discharge period. This period includes the preliminary discharge pulse Pp which causes simultaneous discharge in all the display cells of the PDP, and the preliminary discharge erasing pulse Ppe which eliminates charges, among the wall charges generated by the application of the preliminary discharge pulses, that hinder the writing discharge and the sustaining discharge.

The sustaining discharge period is the period to cause the display cells, which underwent writing discharge during the writing discharge period, to go through sustaining discharge and to luminesce in order to impart them a desired luminance.

During the preliminary discharge period, first, the preliminary pulse Pp is applied to the sustaining electrodes X1 to Xn to cause discharge in all the display cells. Then, the preliminary discharge erasing pulse Ppe is applied to the scanning electrodes Y1 to Yn to generate erasing discharge to eliminate the wall charges accumulated by the preliminary discharge pulse Pp.

Following that, during the writing discharge period, a scanning pulse Pw is applied in line sequence to the scanning electrodes Y1 to Yn, and a data pulse Pd is applied selectively to the data electrodes Di (1□i□k) In accordance with the image display data, and writing discharge is generated in cells to be displayed to generate wall charges. At this time, the display data amount to be subjected to writing discharge is detected for each line by the display data amount detection circuit 81, which is stored temporarily until the sustaining discharge period begins.

Then, during the sustaining discharge period, only the display cells which underwent writing discharge are subjected to consecutive sustaining discharge by the sustaining pulses Pc and Ps. After the final sustaining discharge is completed by the final sustaining pulse Pce, the formed wall charges are eliminated by the sustaining discharge erasing pulse Pse, and luminous operation for one screen is completed by stopping the sustaining discharge. In these operations, the sustaining pulses Pc and Ps are generated by the control signal for slope forming switch and the control signal for clamping switch n, and the detected display data amount DAC temporarily stored is input to the delay time control circuit 91, and controls the delay time from the turn-on of the control signal for slope forming waveform to the turn-on of the control signal for clamping switch for each line corresponding to the detected display data amount. By causing a flow of a predetermined sustaining discharge current in each line even if the display data amount (display load amount) to be subjected to writing discharge varies, the luminance can be corrected, as shown by the broken line in FIG. 14, luminance variations can be reduced among the lines, gradations of the display data can be faithfully displayed, and an excellent display quality can be obtained.

Embodiment 3

In the first and second embodiments, the points of impedance change in the sustaining pulse circuit during the sustaining discharge period are variably controlled dynamically for each line, corresponding to the detected display data amount by detecting for each line the display data amount to be subjected to writing discharge. In this embodiment, it is confirmed that the same effect can be achieved by detecting the display data amount to be subjected to writing discharge for each sub-field, instead of for each line, and variably control dynamically the points of impedance change in the sustaining pulse circuit during the sustaining discharge period, for each sub-field, in accordance with the detected display data amount.

Furthermore, in the first and second embodiments, the points of impedance change in the sustaining pulse circuit during the sustaining discharge period are variably controlled dynamically for each line corresponding to the detected display data amount by detecting the display data amount to be subjected to writing discharge for each line. However, the same effect can be achieved by detecting the display data amount to be subjected to writing discharge for each field, instead of for each line, and variably control dynamically the points of impedance change in the sustaining pulse circuit during the sustaining discharge period, for each field, in accordance with the detected display data amount.

According to the drive unit and drive method of the present invention, prescribed luminance can be obtained when the display load amount is large, and no luminance saturation takes place when the display load amount is small. As a result, a satisfactory image quality can be obtained irrespective of the magnitude of the display load amount.

Moreover, even if the display data amount to be subjected to writing discharge changes from one line to another, it is possible to reduce the luminance difference among the lines to display faithfully the gradations of display data, and to realize a drive unit and a drive method of the plasma display panel with excellent display quality.

What is claimed is:

1. An apparatus for driving a plasma display panel in which sub-fields are luminesced with prescribed gradations using a number, n, sustaining pulses, the apparatus comprising:

an arithmetic means for calculating a display load amount of a display cell; and a variable means by which an amount of time from the start of charge recovery of said sustaining pulses to a fixation of an output line to a sustaining potential and the time to the fixation to the ground potential are made variable and wherein said variable means is controlled according to a calculation result of said arithmetic means.

2. The apparatus for driving a plasma display panel as claimed in claim 1, wherein said variable means comprises:

a first switching means for fixing at least one of the sustaining pulses to the ground potential;

a second switching means for fixing at least one of the sustaining pulses to the sustaining potential;

a third switching means for guiding a charge on a display cell of the plasma display panel to a recovery capacitor;

a fourth switching means for guiding a charge on the recovery capacitor to the display cell; and a control circuit operable to control switching timings of the first through fourth switching means.

3. A method of driving a plasma display panel in which sub-fields are luminesced with prescribed gradations using a plurality of sustaining pulses, the method comprising:

calculating a display load amount of a display cell using an arithmetic means;

varying an amount of time from a start of charge recovery of the sustaining pulses to a fixation of an output line to a sustaining potential and a time from the fixation to a ground potential based on the calculation result of the arithmetic means.

4. The drive method of a plasma display panel as claimed in claim 3, wherein the time from the start of charge recovery of said sustaining pulses to the fixation to the sustaining potential and the time to the fixation to the ground potential are made gradually longer extending from the leading sustaining pulse towards an n-th sustaining pulse.

5. A method of driving a plasma display panel provided with a plurality of scanning electrodes, a plurality of sustaining electrodes formed in pairs with the scanning electrodes on the same plane, a plurality of data electrodes formed in the direction perpendicular to the scanning electrodes and the sustaining electrodes, and a plurality of display cells formed at the intersections of the data electrodes with the pairs of scanning electrodes and the sustaining electrodes, method comprising:

providing a writing discharge period for deciding lighting or nonlighting of each of a plurality of display cells and a sustaining discharge period for conducting repeated luminous discharge based on selective discharge during the writing discharge period;

detecting a display data to be subjected to writing discharge during said writing discharge period, storing a display load amount of the detected display data temporarily;

controlling the impedance of a sustaining pulse circuit variably, corresponding to the display load amount of the detected display data at switching of sustaining pulses during said sustaining discharge period.

6. The drive method of a plasma display panel as claimed in claim 5, wherein a point of impedance change in said sustaining pulse circuit; is variably controlled dynamically.

7. The drive method of a plasma display panel as claimed in claim 5, wherein the detection of said scanning data is conducted for each line and the impedance of said sustaining pulse circuit is variably controlled for each line.

8. The drive method of a plasma display panel as claimed in claim 5, wherein the time from the rise or fall of the sustaining pulse to the clamping of a sustaining potential is variably controlled dynamically so as to variably control the point of impedance change in said sustaining pulse circuit at switching of the sustaining pulse during said sustaining discharge period.

9. The drive method of a plasma display panel as claimed in claim 6, wherein a high impedance circuit is brought to an active state first, then a low impedance circuit is brought to an active state, and the time from the start of the high impedance circuit becoming active to the start of the low impedance circuit becoming active is variably controlled dynamically so as to variably control the point of impedance change in said sustaining pulse circuit at switching of the sustaining pulse during the sustaining discharge period.

10. The drive method of a plasma display panel as claimed in claim 5, wherein the detection of said display data is conducted separately for each sub-field and the impedance of said sustaining pulse circuit is variably controlled for each sub-field separately.

11. The drive method of a plasma display panel as claimed in claim 5, wherein the detection of said display data is conducted separately for each field and the impedance of said sustaining pulse circuit is variably controlled for each field separately.

12. An apparatus for driving a plasma display panel having means for resetting each display cell, writing discharge means for deciding lighting or nonlighting of each display cell, and sustaining discharge means for conducting repeated luminous discharge based on selective discharge of the writing discharge means the apparatus comprising:

means for detecting display data performing writing discharge for each of a plurality of lines, means for counting and storing a display load amount of the detected display data, and means for variably controlling dynamically an impedance of the sustaining discharge means for each line at switching of the sustaining pulse during said sustaining discharge period corresponding to the display load amount of the detected display data.

13. The drive apparatus of a plasma display panel as claimed in claim 12, wherein said sustaining discharge means comprises high impedance circuits and low impedance circuits.

14. The drive apparatus of a plasma display panel as claimed in claim 12, wherein said high impedance circuit is composed of a circuit for causing rise or fall of the sustaining pulse, said low impedance circuit is composed of a circuit for clamping the output line to a sustaining voltage and a circuit for holding the output line at the sustaining voltage, where the circuit for causing rise or fall of said sustaining pulse is formed in such a way as to include also reactive power recovery means.

* * * * *